US008526847B2

(12) United States Patent
Kataoka

(10) Patent No.: US 8,526,847 B2
(45) Date of Patent: Sep. 3, 2013

(54) IMAGE FORMING APPARATUS AND DEVELOPING DEVICE

(75) Inventor: Naoki Kataoka, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 156 days.

(21) Appl. No.: 13/171,790

(22) Filed: Jun. 29, 2011

(65) Prior Publication Data

US 2012/0002983 A1 Jan. 5, 2012

(30) Foreign Application Priority Data

Jul. 1, 2010 (JP) ..... 2010-151323

(51) Int. Cl.
*G03G 15/00* (2006.01)

(52) U.S. Cl.
USPC ..... 399/107; 399/106

(58) Field of Classification Search
USPC ..... 399/41, 111, 225, 256, 259, 262, 399/263
See application file for complete search history.

(56) References Cited

U.S. PATENT DOCUMENTS

| | | | | |
|---|---|---|---|---|
| 5,450,178 | A | 9/1995 | Kawashima et al. | |
| 5,548,385 | A | 8/1996 | Takai et al. | |
| 5,915,155 | A | 6/1999 | Shoji et al. | |
| 6,920,301 | B2 * | 7/2005 | Arimoto | 399/227 |
| 7,522,866 | B2 * | 4/2009 | Deguchi et al. | 399/262 |
| 7,627,260 | B2 * | 12/2009 | Shiraishi et al. | 399/58 |
| 7,783,232 | B2 | 8/2010 | Minami et al. | |
| 2006/0216067 | A1 * | 9/2006 | Okoshi | 399/258 |
| 2009/0142078 | A1 | 6/2009 | Niijima | |
| 2012/0177390 | A1 | 7/2012 | Niijima | |

FOREIGN PATENT DOCUMENTS

| | | |
|---|---|---|
| JP | 2-21591 B2 | 5/1990 |
| JP | 04-118675 A | 4/1992 |

(Continued)

OTHER PUBLICATIONS

Office Action (Notification of Reasons for Refusal) dated Apr. 24, 2012, issued in corresponding Japanese Patent Application No. 2010-151323, and an English Translation thereof (with Verification of Translation). (6 pages).

(Continued)

*Primary Examiner* — Walter L Lindsay, Jr.
*Assistant Examiner* — Matthew Miller
(74) *Attorney, Agent, or Firm* — Buchanan Ingersoll & Rooney PC

(57) ABSTRACT

An image forming apparatus comprises: a developing device having an outlet from which a two-component developer is partially discharged while the two-component developer is conveyed; a hopper to which (i) a first cartridge containing a first developer including carriers and (ii) a second cartridge containing a second developer including toner and not carriers are attachable, and operable, when the first cartridge is attached thereto, to supply the first developer to the developing device, and when the second cartridge is attached thereto, to supply the second developer to the developing device; and a switching part operable, when the first developer is supplied, to switch the developing device to a first state in which the two-component developer is partially discharged from the outlet, and when the second developer is supplied, to switch the developing device to a second state in which the two-component developer is not discharged from the outlet.

11 Claims, 14 Drawing Sheets

(56) References Cited

FOREIGN PATENT DOCUMENTS

| | | | |
|---|---|---|---|
| JP | 06-250524 | A | 9/1994 |
| JP | 09-197784 | A | 7/1997 |
| JP | 2007-072328 | A | 3/2007 |
| JP | 2009-134032 | A | 6/2009 |

OTHER PUBLICATIONS

Official Action issued by the Chinese Patent Office on Nov. 5, 2012 in Chinese Application No. 20111089378.7 and English Translation of Official Action (13 pages).

* cited by examiner

<Trickle corresponding position>

<Non-trickle corresponding position>

(Front side of device) (Back side of device)

<Trickle corresponding position>

<Non-trickle corresponding position>

(Corresponding to non-trickle)

(Corresponding to trickle)

IMAGE FORMING APPARATUS AND DEVELOPING DEVICE

This application is based on application No. 2010-151323 filed in Japan, the contents of which are hereby incorporated by reference.

BACKGROUND OF THE INVENTION (1) Field of the Invention

The present invention relates to an image forming apparatus and a developing device for developing an electrostatic latent image on an image carrier using a developer, the image forming apparatus including the developing device.

(2) Description of the Related Art

An image forming apparatus, such as a copier or a printer, includes a developing device which contains a two-component developer including carriers and toner, and develops an electrostatic latent image formed on a photosensitive drum.

Examples of a developing method include a so-called trickle developing method. In this method, a developer including fresh carriers (i.e., fresh developer) is supplied into a housing of a developing device little by little via an inlet of the housing. At the same time, developer in the housing is agitated and circularly conveyed. While the developer is being conveyed, an excess amount of developer due to the supply of the fresh developer overflows and is discharged outside the housing via an outlet of the housing (Japanese examined patent application publication No. H02-21591).

According to the trickle developing method, the fresh developer is supplied into the housing from a cartridge, and whereby old carriers in the housing are replaced by fresh carriers and discharged outside the housing. Therefore, deteriorated carriers are less likely to remain in the housing, and deterioration in the developer is suppressed for a long period of time. This realizes high image quality in forming images.

Although realizing high image quality, the use of a developing device for the trickle developing method as described above is costly. This is because such a developing device requires a large amount of fresh developer for supply, and a two-component developer is discharged from the developing device.

Suppose here that a user sometimes needs to print out images having high image quality, such as pictures, but other times needs to print out images that do not require high image quality, such as images including only characters. In this case, the user may not wish to use the developing device for the trickle developing method all the time, since it is costly although providing high image quality.

Here, a normal developing method, which is not the trickle developing method, is less costly. In this method, a two-component developer in a housing is not discharged via an outlet, and a fresh developer including toner and not carriers is supplied into the housing from a cartridge. However, such a normal developing method cannot provide high image quality for a long period of time.

For example, it is possible to prepare two developing devices, i.e., one for the trickle developing method and the other for a normal non-trickle developing method. Then, the user may switch between the two developing devices as necessary. This structure, however, is costly as it requires two types of developing devices. Also, the user needs to keep one of the developing devices not mounted in the image forming apparatus somewhere different from the image forming apparatus, which is bothersome.

SUMMARY OF THE INVENTION

The present invention has been achieved in view of the above problems, and an aim thereof is to provide an image forming apparatus and a developing device that realize high image quality and low cost as desired by a user.

The above aim is achieved by an image forming apparatus for developing an electrostatic latent image on an image carrier with use of a two-component developer including carriers and toner, the image forming apparatus comprising: a developing device having (i) a conveyance path in which the two-component developer is conveyed and (ii) an outlet from which the two-component developer is partially discharged while the two-component developer is conveyed; a hopper to which (i) a first cartridge containing a first developer including carriers and (ii) a second cartridge containing a second developer including toner and not carriers are attachable, and operable, when the first cartridge is attached thereto, to supply the first developer to the developing device, and when the second cartridge is attached thereto, to supply the second developer to the developing device; and a switching part operable, when the first developer is supplied, to switch the developing device to a first state in which the two-component developer is partially discharged from the outlet, and when the second developer is supplied, to switch the developing device to a second state in which the two-component developer is not discharged from the outlet.

Also, the above aim is achieved by a developing device mounted in an image forming apparatus, and for developing an electrostatic latent image on an image carrier with use of a two-component developer including carriers and toner, the developing device comprising: a conveyance path in which the two-component developer is conveyed, an outlet that is provided in the conveyance path and from which the two-component developer is partially discharged while the two-component developer is conveyed; an inlet that is provided in the conveyance path and from which (i) a first developer including carriers is supplied when a cartridge containing the first developer is attached to the image forming apparatus and (ii) a second developer including toner and not carrier is supplied when a cartridge containing the second developer is attached to the image forming apparatus; and a switching part operable, when the first developer is supplied, to switch the developing device to a first state in which the two-component developer is discharged from the outlet, and when the second developer is supplied, to switch the developing device to a second state in which the two-component developer is not discharged from the outlet.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

Embodiment 1

The following describes an embodiment of an image forming apparatus according to the present invention, by taking a tandem-type color digital copier (hereinafter, simply "copier") as an example.

Figure 1:
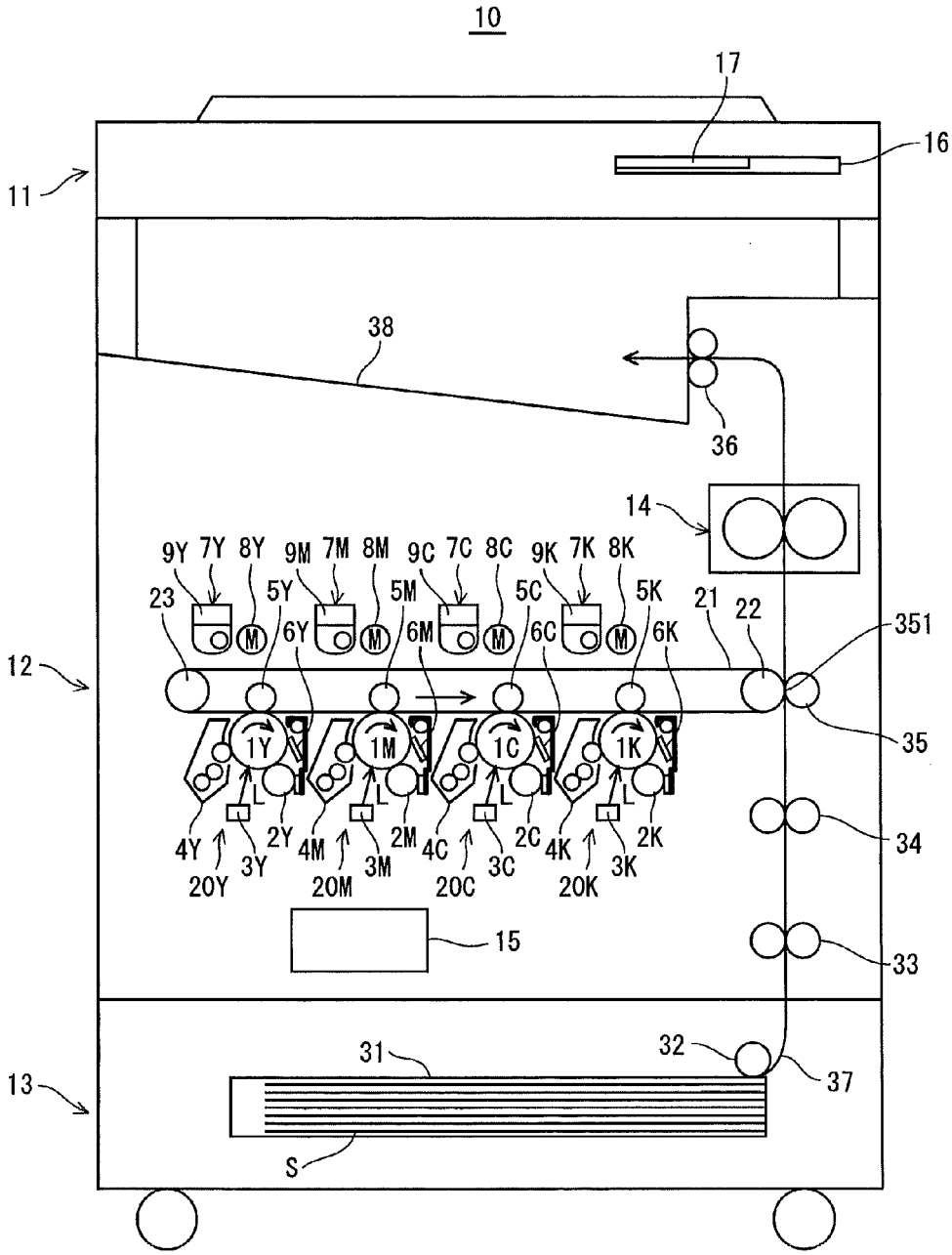
FIG. 1 shows an overall structure of a copier 1 according to Embodiment 1.

FIG. 1 shows an overall structure of a copier 10 according to Embodiment 1.

As shown in FIG. 1, the copier 10 includes an image reader 11, an image former 12, a paper feeder 13, a fixer 14, a controller 15, an operation panel 16, etc. The copier 10 forms a color image using yellow (Y), magenta (M), cyan (C) and black (K) or a monochrome image using black, for example, and reproduces the image on a recording sheet. Hereinafter, the reproduction colors of yellow, magenta, cyan, and black are represented as Y, M, C, and K, respectively.

The image reader 11 obtains image data by reading an image on a document set thereto, and outputs the image data.

The image former 12 includes imaging parts 20Y to 20K that respectively correspond to colors Y to K, an intermediate transfer belt 21, hoppers 7Y to 7K, supply motors 8Y to 8K, etc.

The imaging parts 20Y to 20K respectively include photosensitive drums 1Y to 1K, charge rollers 2Y to 2K, exposure parts 3Y to 3K, developing devices 4Y to 4K, primary transfer rollers 5Y to 5K, cleaners 6Y to 6K for cleaning the photosensitive drums 1Y to 1K, etc, and form toner images of Y to K on the photosensitive drums 1Y to 1K. The charge rollers 2Y to 2K, the exposure parts 3Y to 3K, the developing devices 4Y to 4K, the primary transfer rollers 5Y to 5K, and the cleaners 6Y to 6K are all disposed around the photosensitive drums 1Y to 1K.

Each of the developing devices 4Y to 4K contains a two-component developer that includes carriers and toner (hereinafter "developer"), and is switchable between (i) a trickle developing method as a first developing method and (ii) a normal developing method as a second developing method (hereinafter "non-trickle developing method").

The intermediate transfer belt 21 is endless and suspended by a driving roller 22 and a driven roller 23 in a tensioned manner. The intermediate transfer belt 21 is driven to rotate in the direction of arrow A in FIG. 1.

A cartridge 9Y, which contains a Y-color developer for supply, is attachable to the hopper 7Y. The hopper 7Y supplies the Y-color developer to the developing device 4Y by an instruction from the controller 15. The cartridge 9Y comes in two types, i.e., a first cartridge containing a first developer that includes carriers and toner, and a second cartridge containing a second developer that includes toner and not carriers. The cartridge 9Y is exchangeable between two types of cartridges, i.e., the first and second cartridges, and either the first cartridge or the second cartridge is attached to the hopper 7Y.

The cartridge 9Y is exchangeable between two types and attachable to the hopper 7Y, so that when the developing method is switched between the trickle developing method and the non-trickle developing method, a developer corresponding to the developing method that has been switched to is supplied. The cartridge 9Y is attachable and detachable by a user (i.e., operator).

The same applies to the other hoppers 7M to 7K, and cartridges 9M to 9K are detachable from the hoppers 7M to 7K, respectively. The cartridges 9M to 9K come in two types, i.e., first and second types, and contain developers M to K, respectively. The hoppers 7M to 7K supply developers in the cartridges 9M to 9K attached thereto, to the developing devices 4M to 4K, by an instruction from the controller 15.

The paper feeder 13 includes a paper feed cassette 31, a feed roller 32, a conveyance roller pair 33, a timing roller pair 34, a secondary transfer roller 35, etc. The paper feed cassette 31 contains sheets S. The feed roller 32 feeds the sheets S in the paper feed cassette 31, one at a time, onto a conveyance path 37. The conveyance roller pair 33 conveys the sheet S that has been fed, and the timing roller pair 34 adjusts the timing for conveying the sheet S to a secondary transfer position 351.

The fixer 14 includes a fixing roller and a pressure roller that are pressed against each other, and a heater for heating the fixing roller.

The operation panel 16 includes keys and a liquid crystal display 17. The keys receive instructions (e.g., a copying instruction), and selections (e.g., color mode or monochrome mode). The liquid crystal display 17 displays information for giving a notification or a warning to a user.

Upon receiving an instruction for copying or the like via the operation panel 16 from the user, the controller 15 controls the image reader 11, the image former 12, etc. to start a copying operation based on the instruction. Specifically, the controller 15 causes the image reader 11 to read a document image, thereby obtaining image data. Then, the controller 15 drives laser diodes of the exposure parts 3Y to 3K, based on the image data. As a result, the laser diodes of the exposure parts 3Y to 3K emit laser beams L respectively corresponding to the colors Y to K, and the photosensitive drums 1Y to 1K are exposure-scanned on a line-by-line basis.

The photosensitive drums 1Y to 1K are uniformly charged by the charge roller 2Y to 2K before the exposure scanning, so that electrostatic latent images are formed on the photosensitive drums 1Y to 1K by the exposure scanning of the laser beams L. The electrostatic latent images on the photosensitive drums 1Y to 1K are developed (i.e., visualized) by developers contained in the developing devices 4Y to 4K. As a result, toner images are formed on the photosensitive drums 1Y to 1K.

The toner images on the photosensitive drums 1Y to 1K are sequentially primary-transferred onto the intermediate transfer belt 21, by the electrostatic force acting between the primary transfer rollers 5Y to 5K and the photosensitive drums 1Y to 1K. At this time, the toner images are transferred to the same position on the intermediate transfer belt 21 at different timings, so that they are superimposed on each other at the position. After being superimposed on the intermediate transfer belt 21, the toner images of the respective colors are conveyed to the secondary transfer position 351 by the rotation of the intermediate transfer belt 21.

In the meanwhile, the paper feeder 13 feeds a sheet S via the timing roller pair 34 to the secondary transfer position 351 at the timing when the toner images are conveyed thereto. The sheet S, which has been fed by the paper feeder 13, passes through between the intermediate transfer belt 21 and the secondary transfer roller 35. When the sheet S passes through therebetween, the toner images on the intermediate transfer belt 21 are collectively secondary-transferred onto the sheet S, by the electrostatic force acting between the secondary transfer roller 35 and the driving roller 22.

After passing the secondary transfer position 351, the sheet S is conveyed to the fixer 14. When the sheet S passes through the fixer 14, the toner images on the sheet S are fixed onto the sheet S by heat and pressure. The sheet S passes through an ejection roller pair 36 and is ejected onto an ejection tray 38.

The above describes an operation in the case of color mode for forming a color image. However, in the case of monochrome mode for forming only an image of the color K for example, only the imaging part 20K for the color K is driven to form a K-color toner image.

Figure 2:
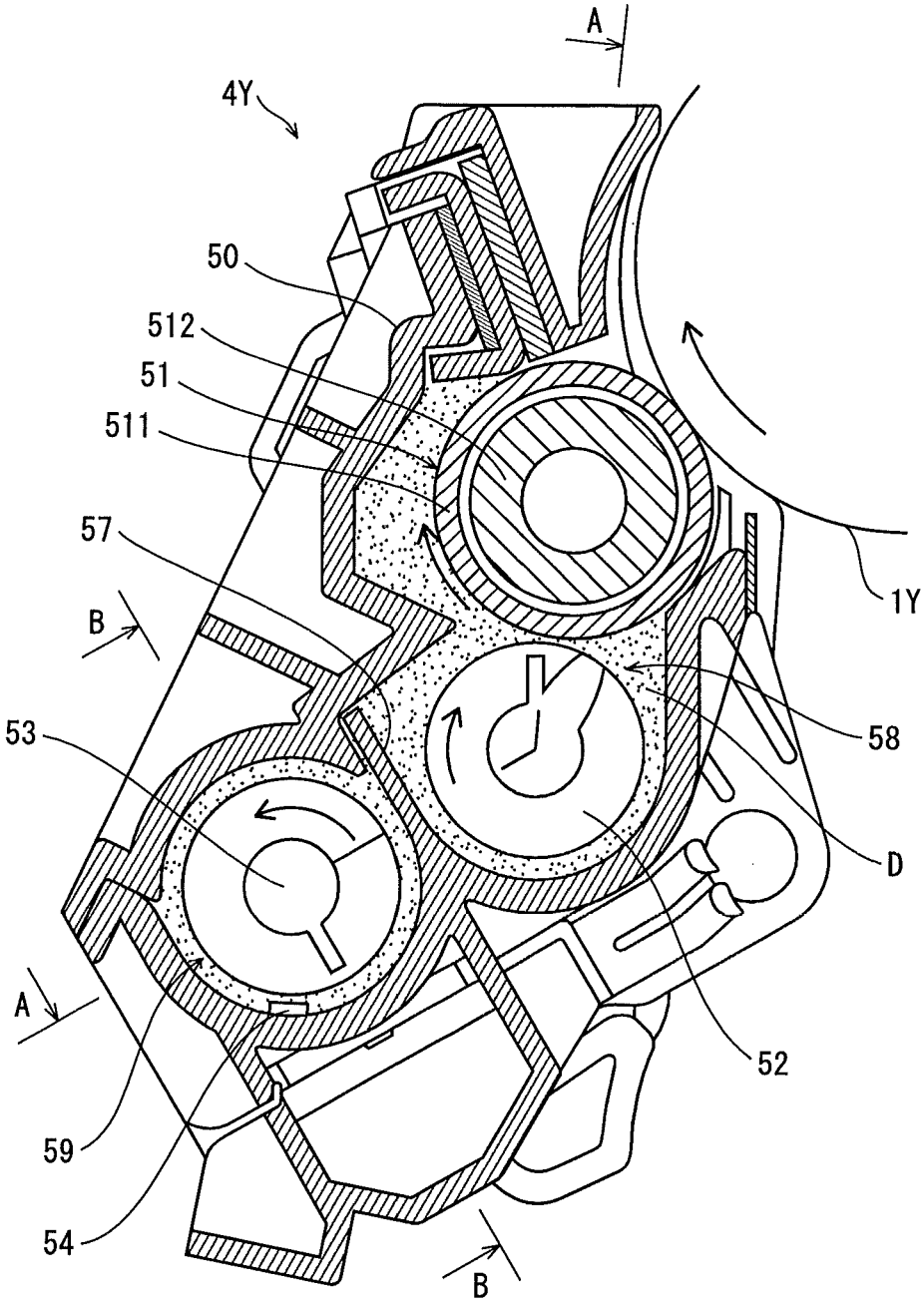
FIG. 2 is a sectional view showing a structure of a developing device in the copier.
Figure 3:
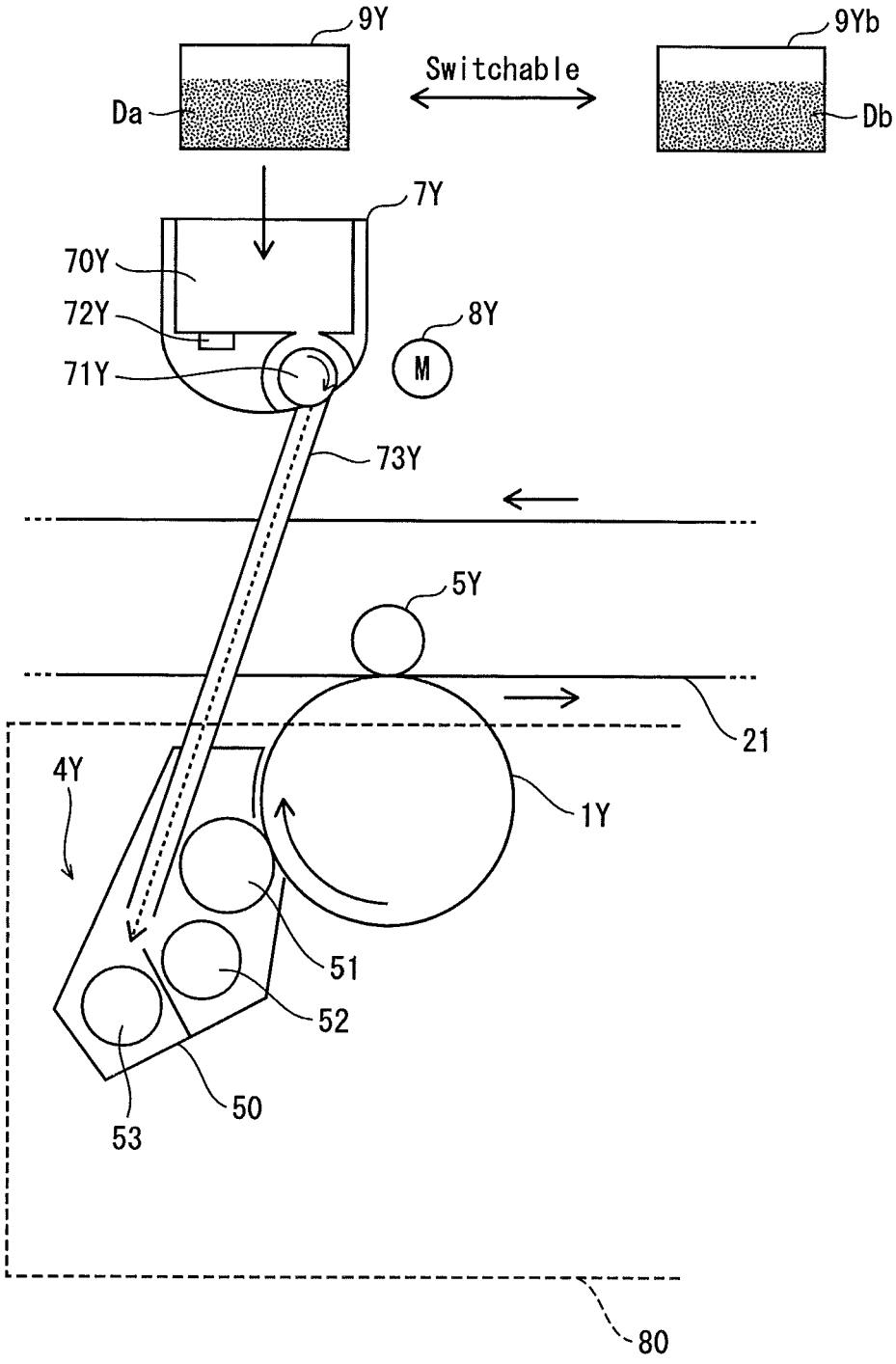
FIG. 3 schematically shows a hopper in the copier supplying toner to the developing device.
Figure 4:
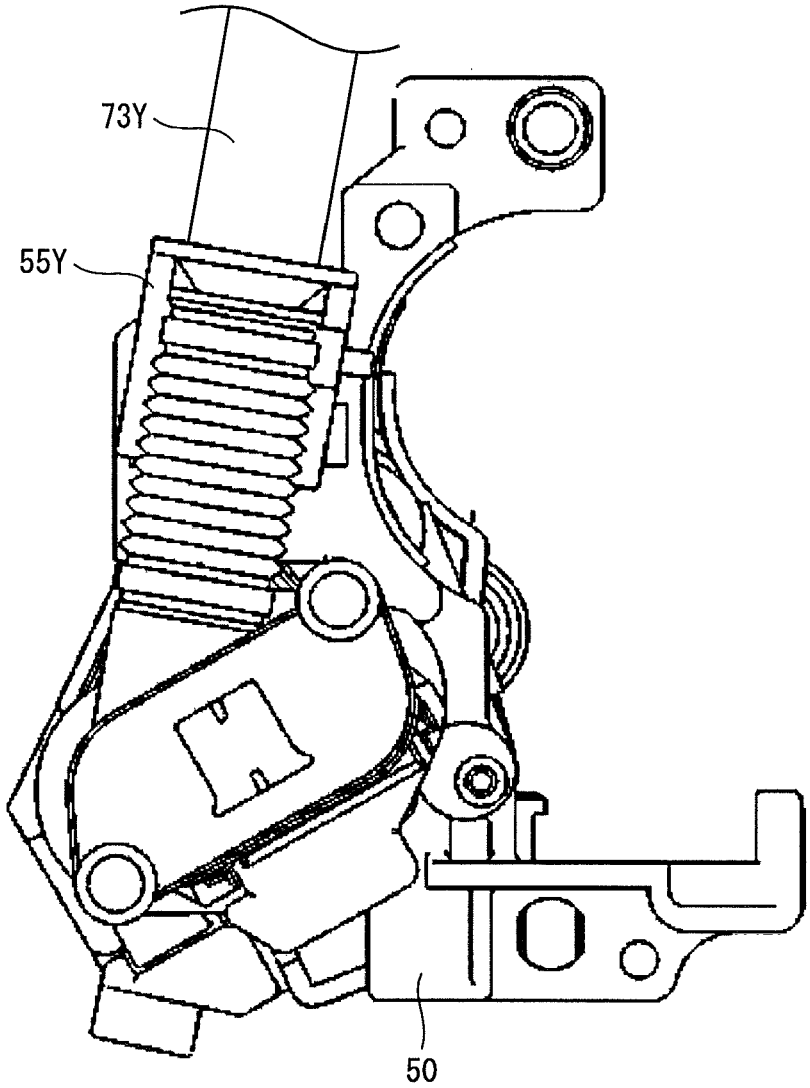
FIG. 4 shows the developing device seen from the front of the copier.

FIG. 2 is a sectional view showing a structure of the developing device 4Y. FIG. 3 schematically shows the hopper 7Y supplying toner to the developing device 4Y. FIG. 4 shows the developing device 4Y seen from the front of the copier 10. For the convenience of description, FIG. 3 does not show the exposure part 3Y and so on. Although using developers of different colors, the developing devices 4Y to 4K and the hoppers 7Y to 7K have the same structures. Therefore, the following describes the developing device 4Y and the hopper 7Y, and descriptions of the structures of the other developing devices 4M to 4K and hoppers 7M to 7K are omitted.

As shown in FIG. 2, the developing device 4Y includes a housing 50, a developing roller 51, a supply screw 52, an agitation screw 53, and a developer detection sensor 54. The components from the housing 50 to the agitation screw 53 are elongated along an axis direction of the photosensitive drum 1Y (i.e., a direction perpendicular to a paper surface: hereinafter "axis direction").

The housing 50 is partitioned by a partition (i.e., dividing wall) 57 into upper and lower portions, i.e., a supply chamber 58, an agitation chamber 59, etc. The developing roller 51 and the supply screw 52 are disposed in the supply chamber 58 and the agitation screw 53 is disposed in the agitation chamber 59. The supply chamber 58 and the agitation chamber 59 contain a developer D.

The developing roller 51 is disposed at an opening of the supply chamber 58, the opening facing the photosensitive drum 1Y. The developing roller 51 includes a developing sleeve 511 and a magnet roller 512. The developing sleeve 511 is tubular, and the magnet roller 512 is inserted in the developing sleeve 511 along the axis direction.

The magnet roller 512 includes a plurality of magnetic poles, i.e., N-poles and S-poles. For example, the N-poles and the S-poles are disposed alternately along the circumferential direction of the magnet roller 512. An edge of the magnet roller 512 in the axis direction is fixed to the housing 50 so as to prevent the magnet roller 512 from rotating. Each of the magnetic poles extends along the axis direction.

The developing sleeve 511 is partially exposed from the opening of the housing 50 so as to face the photosensitive drum 1Y. The developing sleeve 511 is held by the housing 50 in a manner that the developing sleeve 511 is rotatable in the direction of an arrow shown in FIG. 2. The developing sleeve 511 rotates around the magnet roller 512 that is stationary, while holding (i.e., carrying) the developer D on its surface by the magnetic force of the magnet roller 512.

The supply screw 52 is disposed in the supply chamber 58, and faces the photosensitive drum 1Y with the developing roller 51 in between. The supply screw 52 is rotatably held by the housing 50 parallel to the developing roller 51 in the axis direction. The supply screw 52 rotates in the direction of an arrow shown in FIG. 2, thereby conveying the developer D in the supply chamber 58 along the axis direction and supplying the developer D to the developing roller 51.

The agitation screw 53 is disposed in the agitation chamber 59, and is rotatably held by the housing 50 parallel to the developing roller 51 in the axis direction. The agitation screw 53 rotates in the direction of an arrow shown in FIG. 2, thereby conveying and agitating the developer D in the agitation chamber 59 along a direction opposite from the direction of the supply screw 52 conveying the developer D. The developing sleeve 511, the supply screw 52, and the agitation screw 53 rotate by the drive force of a motor that is not shown in figures.

The developer detection sensor 54 is disposed at the bottom of the agitation chamber 59, and measures the ratio of carriers to toner that are both included in the developer D conveyed inside the agitation chamber 59. The developer detection sensor 54 transmits, to the controller 15, a detection signal indicating the ratio of the carriers to the toner. The controller 15 controls the supply of the developer from the hopper 7Y to the developing device 4Y, such that the ratio of the carriers to the toner falls within an appropriate range. Specifically, the controller 15 performs this control by driving the supply motor 8Y, based on the detection signal transmitted from the developer detection sensor 54. Details of this control are described later.

As shown in FIG. 3, the hopper 7Y includes a cartridge housing 70Y, a spiral roller 71Y, and a cartridge type detection sensor 72Y.

The cartridge housing 70Y is provided for housing the cartridge 9Y that contains a developer Da. The cartridge 9Y is detachable from the cartridge housing 70Y. As described above, the cartridge 9Y comes in two types, i.e., the first cartridge containing the first developer that includes carriers and toner, and the second cartridge containing the second developer that includes toner and not carriers.

In FIG. 3, "9Y" denotes the first cartridge, "Da" denotes the first developer in the first cartridge 9Y, "9Yb" denotes the second cartridge, and "Db" denotes the second developer in the second cartridge 9Yb.

The first cartridge 9Y corresponds to the trickle developing method, and the second cartridge 9Yb corresponds to the non-trickle developing method. Therefore, in the case of using the trickle developing method, the first cartridge 9Y is attached so as to supply the first developer that corresponds to the trickle developing method.

In the case of switching to the non-trickle developing method, the second cartridge 9Yb is attached so as to supply the second developer that corresponds to the non-trickle developing method. The same applies to the case with the other colors. That is, first cartridges 9M, 9C, and 9K correspond to the trickle developing method, and second cartridges 9Mb, 9Cb, and 9Kb (not shown) correspond to the non-trickle developing method.

The spiral roller 71Y rotates by the drive force of the supply motor 8Y, and conveys, to a pipe 73Y, the first developer Da (or the second developer Db) in the cartridge 9Y (or the cartridge 9Yb) that is attached to the hopper 7Y. After being conveyed to the pipe 73Y, the first developer Da (or the second developer Db) passes through the pipe 73Y to be conveyed into the housing 50 of the developing device 4Y, via a developer receiver 55Y (see FIG. 4) provided at an upper portion of the housing 50.

The cartridge type detection sensor 72Y is provided at the cartridge housing 70Y, and outputs, to the controller 15, a signal indicating whether the cartridge set in the cartridge housing 70Y is the first cartridge 9Y or the second cartridge 9Yb. In the present embodiment, the first cartridge 9Y and the second cartridge 9Yb are provided with identification information pieces at predetermined positions thereof. Each identification information piece indicates whether the corresponding cartridge is the first cartridge 9Y or the second cartridge 9Yb. The cartridge type detection sensor 72Y reads the identification information piece of the cartridge set to the cartridge housing 70Y, and transmits the identification information piece to the controller 15. For example, the identification information pieces may be marks that each have a different shape, and the cartridge type detection sensor 72Y may detect a difference between the mark of the cartridge set to the cartridge housing 70Y and the other mark. Alternatively, the identification information pieces may be barcodes, the cartridge type detection sensor 72Y may read the barcode of the cartridge set to the cartridge housing 70Y.

Upon receiving an identification information piece, the controller 15 judges whether the cartridge set to the cartridge housing 70Y is the first cartridge 9Y or the second cartridge 9Yb, based on the identification information piece (judgment of the type of cartridge). Based on a result of the judgment, the controller 15 outputs, to the user, a warning that indicates switching of the position of a shutter (described later) of the developing device 4Y. Details of the outputting of the warning are described later.

When using the trickle developing method, the user attaches the first cartridge 9Y to the hopper 7Y. When switching to the non-trickle developing method, the user detaches the first cartridge 9Y from the hopper 7Y and attaches the second cartridge 9Yb to the hopper 7Y. When switching from the non-trickle developing method to the trickle developing method, the user detaches the second cartridge 9Yb from the hopper 7Y, and attaches the first cartridge 9Y to the hopper 7Y. In this way, a developer corresponding to the developing method currently being used is supplied from the cartridge containing the developer to the developing device 4Y.

In FIG. 3, a reference sign 80 shown by a dashed line denotes a collection tank (see FIG. 10) for collecting the developer D discharged in the trickle developing method. The collection tank 80 is detachably attached to the copier 10. In the present embodiment, an outer cover is provided on a front side of the copier 10 such that the outer cover can be freely opened and closed. The user can open the outer cover so as to attach/detach the collection tank 80 and to change the cartridge from the front of the copier 10. Note that the collection tank 80 also collects residual toner discharged from the cleaners 6Y to 6K. The residual toner is removed from the photosensitive drums 1Y to 1K by the cleaners 6Y to 6K cleaning the photosensitive drums 1Y to 1K.

Figure 5:
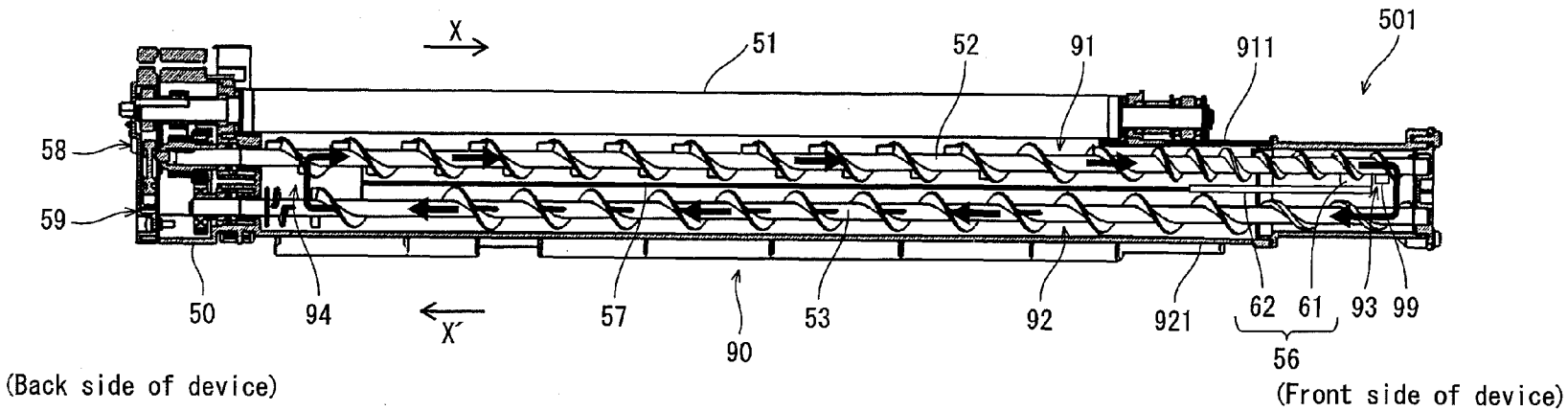
FIG. 5 is a sectional view of the developing device taken along the line A-A in FIG. 2.
Figure 6:
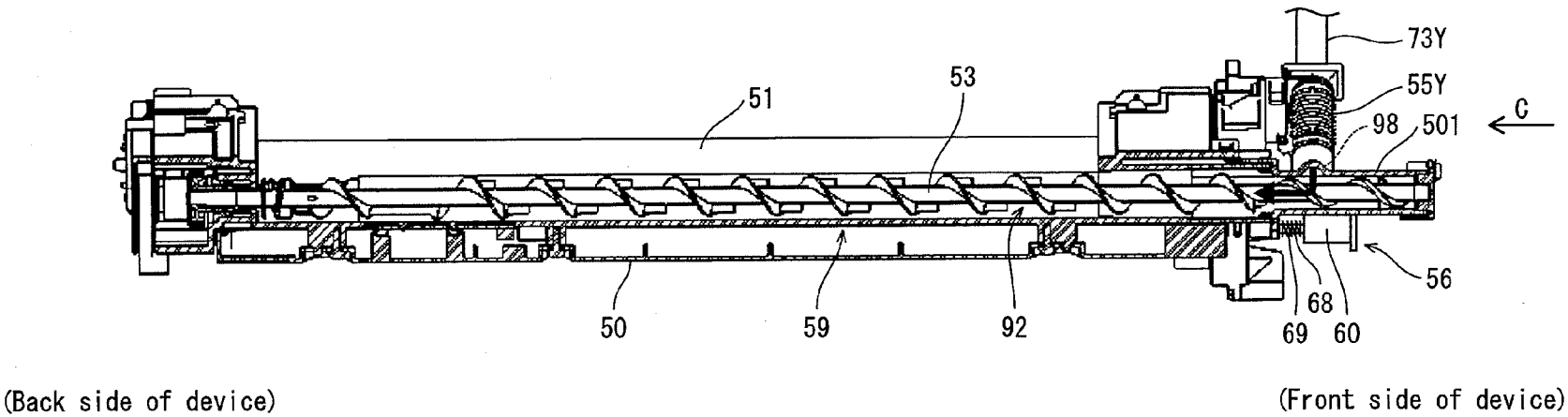
FIG. 6 is a sectional view of the developing device taken along the line A-A in FIG. 2.

FIG. 5 is a sectional view of the developing device 4Y taken along the line A-A in FIG. 2. FIG. 6 is a sectional view of the developing device 4Y taken along the line B-B in FIG. 2. In FIGS. 5 and 6, a crosswise direction corresponds to the axis direction. The right side along the axis direction indicates the front of the copier, and the left side along the axis direction indicates the back of the copier. Note that the developer D is not shown in FIGS. 5 and 6.

As shown in FIGS. 5 and 6, the supply chamber 58 and the agitation chamber 59 in the housing 50 are tubular and elongated along the axis direction. The supply chamber 58 and the agitation chamber 59 are separated from each other by the partition 57, but in communication with each other via (i) opening 93 (see FIG. 5) at one end (right side) of the partition 57 along the axis direction and (ii) opening 94 (see FIG. 5) at the other end (left side) of the partition 57 along the axis direction.

The supply screw 52 is composed of a rotational shaft and a spiral blade provided along the outer circumferential surface of the rotational shaft. Both ends of the supply screw 52 in the axis direction are rotatably held by side walls of the supply chamber 58 via bearings.

The agitation screw 53 is composed of a rotational shaft and a spiral blade provided along the outer circumferential surface of the rotational shaft. Both ends of the agitation screw 53 in the axis direction are rotatably held by side walls of the agitation chamber 59 via bearings.

A gear is attached to each of the developing roller 51, the supply screw 52, and the agitation screw 53, specifically to each of their shaft portions at the back side of the copier 10. The gears are engaged with each other, so that an external rotational drive force is transmitted to the developing roller 51, the supply screw 52, and the agitation screw 53 via the gears, thus driving the developing roller 51, the supply screw 52, and the agitation screw 53 to rotate.

When the developing roller 51, the supply screw 52, and the agitation screw 53 are driven to rotate, the developer D in the supply chamber 58 is conveyed by the supply screw 52 in an X direction shown by the arrow X. While being conveyed by the supply screw 52, the developer D is supplied to the developing roller 51.

When the developer D arrives at the opening 93, which is located at the front side of the copier 10 and at the end of the supply screw 52 in the downstream side in the developer conveyance direction of the supply screw 52, the developer D is conveyed to the agitation chamber 59 via the opening 93.

After being conveyed to the agitation chamber 59, the developer D is further conveyed by the agitation screw 53 in an X' direction shown by the arrow X' (i.e., a direction opposite from the X direction). When the developer D arrives at the opening 94, which is located at the back side of the copier 10 and at the end of the agitation screw 53 in the downstream side in the developer conveyance direction of the agitation screw 53, the developer D is conveyed to the supply chamber 58 via the opening 94. In this way, the developer D is circularly conveyed in the housing 50 in the direction shown by the arrows X and X' in FIG. 5.

In the supply chamber 58, a conveyance path in which the developer D is conveyed by the supply screw 52 in the X direction is referred to as a first conveyance path 92. Also, in the agitation chamber 59, a conveyance path in which the developer D is conveyed by the agitation screw 53 is referred to as a second conveyance path 92.

The opening 93 allows the downstream side of the first conveyance path 91 in the developer conveyance direction to communicate with the upstream side of the second conveyance path 92 in the developer conveyance direction. The opening 93 also serves as a first communication path 93 in which the developer D is conveyed from the first conveyance path 91 to the second conveyance path 92. The opening 94 allows the downstream side of the second conveyance path 92 in the developer conveyance direction to communicate with the upstream side of the first conveyance path 91 in the developer conveyance direction. The opening 94 also serves as a second communication path 94 in which the developer D is conveyed from the second conveyance path 92 to the first conveyance path 91.

As shown in FIG. 6, the first developer Da (or the second developer Db) supplied from the hopper 7Y is conveyed from the developer receiver 55Y of the housing 50, which is provided at the front side of the copier 10, to the agitation chamber 59, via an inlet 98 of the agitation chamber 59 at an end portion thereof located at the front side of the copier 10. When conveyed to the agitation chamber 59, the first developer Da (or the second developer Db) is conveyed and agitated by the agitation screw 53, together with the developer D in the agitation chamber 59.

An outlet 99 of the developer is provided at the bottom of the supply chamber 58 in an end portion thereof located at the front side of the copier 10. Also, a shutter 56 for opening and closing the outlet 99 is provided in the vicinity of the outlet 99.

Figure 7A:
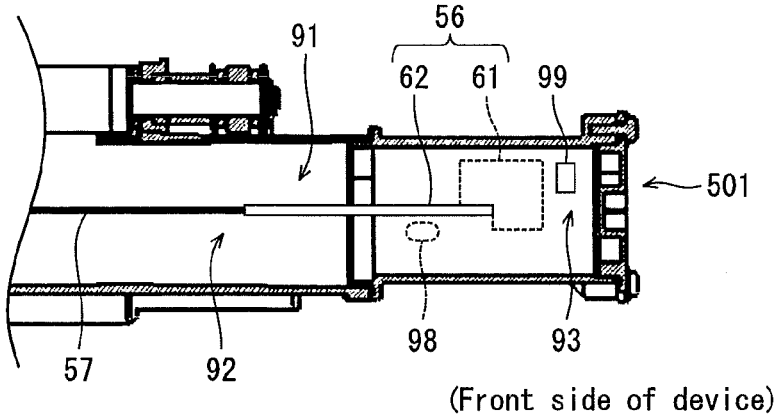
FIGS. 7A and 7B show a structure of a shutter in the developing device.
Figure 7B:
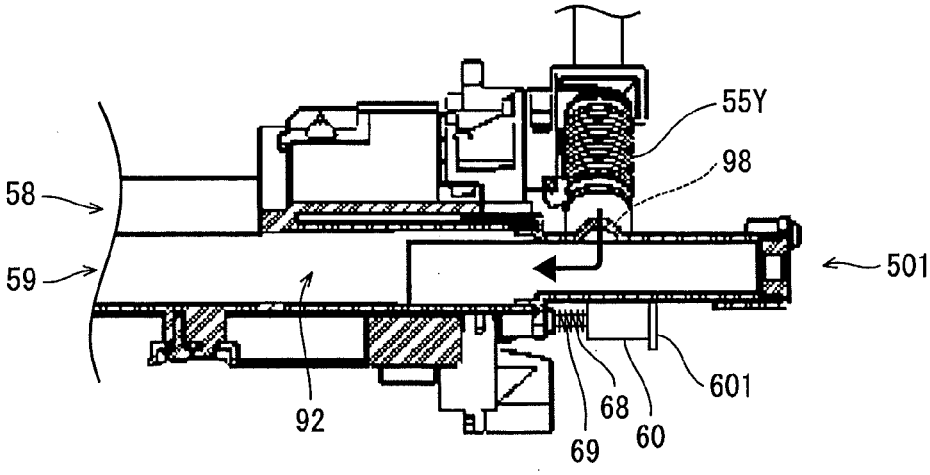
Figure 8:
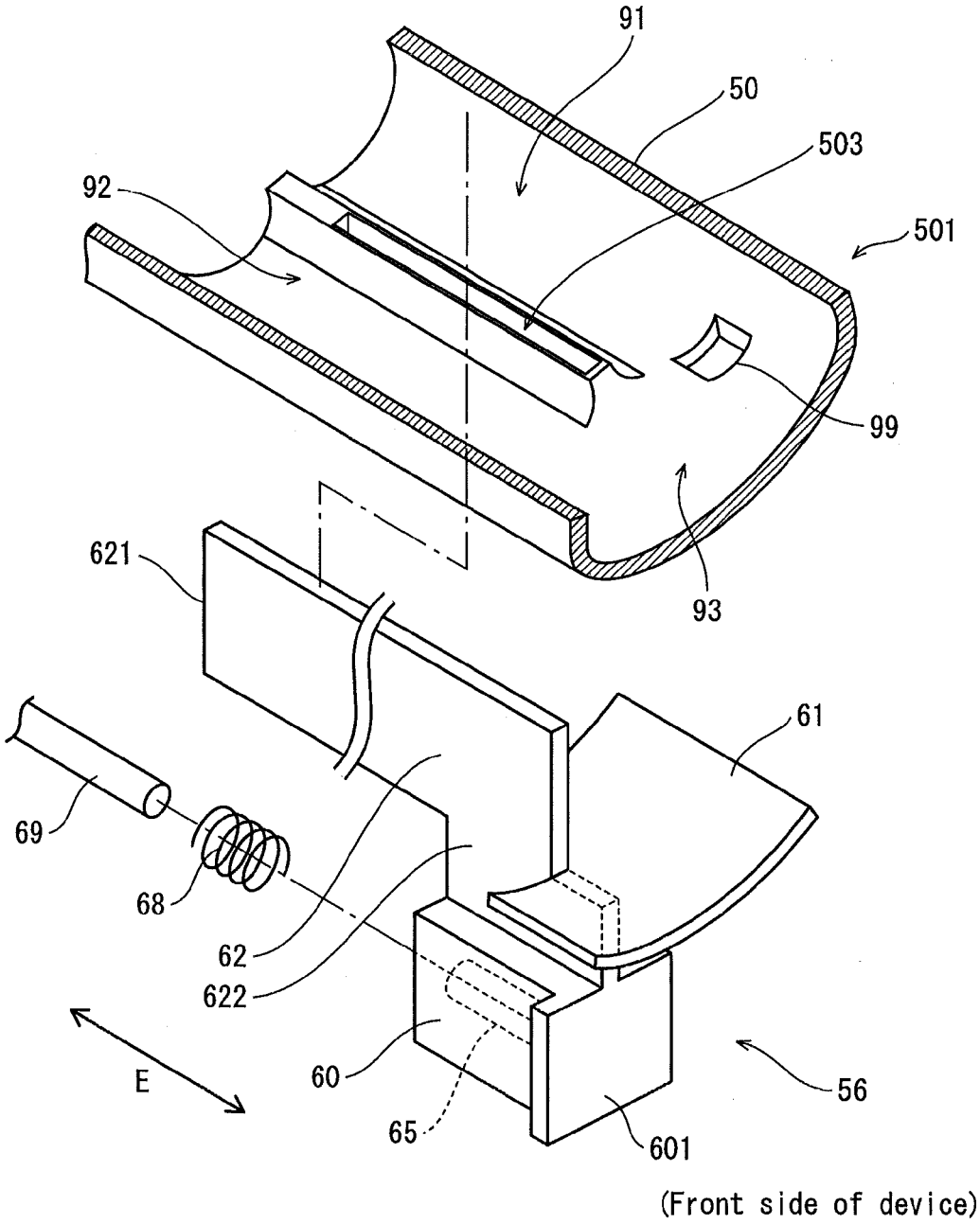
FIG. 8 is a schematic perspective view showing a structure of the shutter.

FIGS. 7A and 7B correspond respectively to FIGS. 5 and 6. In FIGS. 7A and 7B, the supply screw 52 and the agitation screw 53 are not shown so that a structure of the shutter 56 is easily understood. FIG. 8 is a schematic perspective view showing the structure of the shutter 56 and a part of the housing 50 at the front side of the copier 10.

As shown in FIGS. 7A, 7B and 8, the shutter 56 includes a first shutter part 61, a second shutter part 62, and a holder 60. The first shutter part 61 and the second shutter part 62 are formed integrally on the holder 60. The shutter 56 is held by the housing 50 such that the shutter 56 is slidable (i.e., movable) by a predetermined distance along the axis direction (i.e., an E direction shown by an arrow E in FIG. 8).

The first shutter part 61 has the shape of a curved plate, and is positioned outside the housing 50. The first shutter part 61 is bent in an arc so as to be in contact with an outer bottom surface of the supply chamber 58 in the housing 50, and to coincide with the shape of the outer bottom surface thereof. When the shutter 56 is moved to the front side of the copier 10, the first shutter part 61 moves to a closing position for closing the outlet 99 and closes the outlet 99. When the shutter 56 is moved to the back side of the copier 10, the first shutter part 61 moves away from the outlet 99 and to an opening position for opening the outlet 99 and opens the outlet 99.

The second shutter part 62 has the shape of a flat plate elongated in the E direction, and extends inside the housing 50 via an elongated hole 503 (see FIG. 8) that is a through-hole provided at the bottom of the housing 50. The second shutter part 62 is held parallel to the partition 57 (see FIG. 2) provided inside the housing 50.

When the shutter 56 is moved to the back side of the copier 10, an end portion 621 of the second shutter part 62 at the back side of the copier 10 makes contact with the partition 57. As a result, the second shutter part 62 becomes a part of the partition 57 that partitions the housing 50 into the supply chamber 58 and the agitation chamber 59.

When the shutter 56 is moved to the front side of the copier 10, the end portion 621 (see FIG. 8) of the second shutter part 62 moves away from the partition 57. As a result, a part of the partition 57 disappears, and a communication path 95 (see FIG. 9B) for conveying the developer D is newly formed between the supply chamber 58 and the agitation chamber 59.

The communication path 95 (hereinafter, "third communication path") communicates a portion 911 (see FIG. 5) of the first conveyance path 91 with a portion 921 (see FIG. 5) of the second conveyance path 92. The portion 911 is located more upstream in the developer conveyance direction in the first conveyance path 91 than the first communication path 93, and the portion 921 is located more downstream in the developer conveyance direction in the second conveyance path 92 than the first communication path 93. When the developing method is switched to the non-trickle developing method, the third communication path 95 is used as a part of a circulation conveyance path in which the developer D is circularly conveyed. Details of switching of the developing method are described later. The third communication path 95 is formed between the developing roller 51 and the first communication path 93 in the axis direction.

As shown in FIG. 8, the holder 60 is connected to the second shutter part 62 via a connecting part 622. A back surface of the holder 60, which is a surface closer to the back of the copier 10, has a hole 65 (shown by a dashed line) that is elongated. The hole 65 extends from the back surface toward the front side of the copier 10 along the E direction. A pin 69 is disposed at a position facing the opening of the hole 65 of the holder 60. The pin 69 is arranged immediately below the housing 50, parallel to the E direction, pointing toward the front side of the copier 10. The elongated hole 503, which is a through-hole elongated in the E direction, is provided in a part of the housing 50, the part being located at the front side of the copier 10 and between the first conveyance path 91 and the second conveyance path 92.

The second shutter part 62 is inserted from the outside (bottom part) to the inside (upper part) of the housing 50 via the elongated hole 503. In this way, the second shutter part 62 is arranged inside the housing 50, and the connecting part 622 is engaged with the elongated hole 503.

The pin 69 provided for the housing 50 is fit in and engaged with the hole 65 of the holder 60. Also, the connecting part 622 of the shutter 56 is engaged with the elongated hole 503 of the housing 50. In this state, the shutter 56 is held by the housing 50 such that the shutter 56 is slidable along the E direction.

The pin 69 is inserted in a compression coil spring 68. The compression coil spring 68 constantly applies, to the holder 60, a biasing force directed toward the front side of the copier 10. The holder 60 has a head portion 601 at the front side of the copier 10. The head portion 601 has two states, i.e., (i) a pressed state in which the head portion 601 is pressed toward the back side of the copier 10, against the biasing force of the compression coil spring 68, and (ii) a non-pressed state of not being pressed. The state of the head portion 601 is switched between the pressed state and the non-pressed state, thus causing the position of the shutter 56 to be switched between a first position corresponding to the trickle developing method and a second position corresponding to the non-trickle developing method.

Figure 9A:
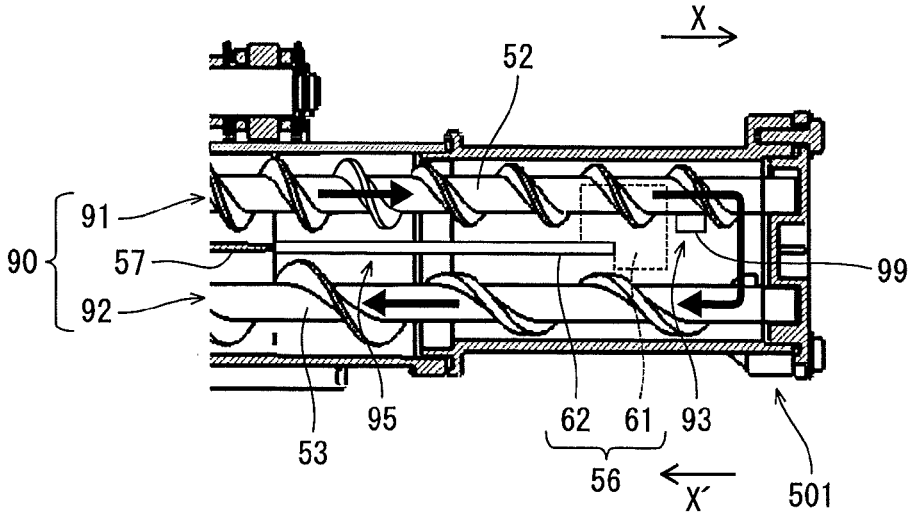
FIG. 9A shows a state where the shutter is located in a first position corresponding to a trickle developing method.
Figure 9B:
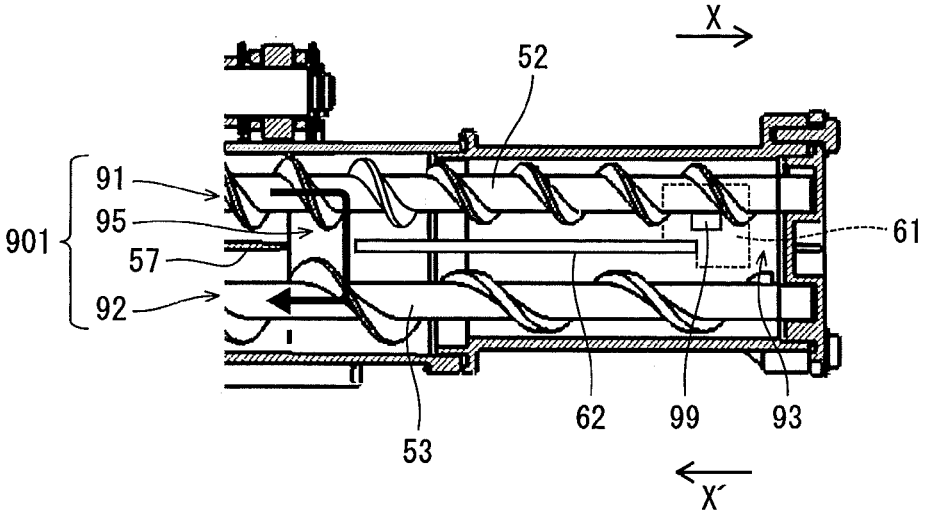
FIG. 9B shows a state where the shutter is located in a second position corresponding to a non-trickle developing method.

FIG. 9A shows the shutter 56 being placed at the first position (trickle corresponding position). FIG. 9B shows the shutter 56 being placed at the second position (non-trickle corresponding position).

As shown in FIG. 9A, in the trickle corresponding position, the first shutter part 61 is positioned away from the outlet 99 so as to open the outlet 99. Also, the second shutter part 62 is positioned at a blocking position for blocking the third communication path 95 by cutting across the third communication path 95. As a result, the second shutter part 62 makes contact with the partition 57 to be a part of the partition 57 and closes the third communication path 95.

When the third communication path 95 is blocked, the developer D conveyed in the X direction by the supply screw 52 in the supply chamber 58 cannot pass through the third communication path 95. Accordingly, the developer D is conveyed toward the first communication path 93 at the front of the copier 10, passes over the outlet 99, and is thereafter conveyed to the agitation chamber 59 via the first communication path 93. While the developer D passes over the outlet 99, a part of the developer D is discharged outside the housing 50 from the outlet 99. According to the trickle developing method described above, although the developer D in the developing device 4Y gets deteriorated, the developer D is gradually replaced with fresh developer. This makes it possible to maintain high image quality over a long period of time, and to reduce the frequency of replacing the deteriorated developer with new one by a service man or the like. As a result, the life of the developer D is prolonged.

In the trickle developing method, the first conveyance path 91, the first communication path 93, the second conveyance path 92, and the second communication path 94 constitute a circulation conveyance path 90 along which the developer D is circularly conveyed.

As shown in FIG. 9B, at the non-trickle corresponding position, the first shutter part 61 moves to the closing position for closing the outlet 99 and closes the outlet 99. Also, the second shutter part 62 moves away from the partition 57 to an opening position for opening the third communication path 95. In this way, a part of the partition 57 disappears, and the third communication path 95 is opened.

Due to the third communication path 95 being open, the developer D in the supply chamber 58, which is conveyed by the supply screw 52 in the X direction, is mostly conveyed to the agitation chamber 59 via the third communication path 95.

In the present Embodiment, the agitation chamber 59 is located obliquely downward with respect to the supply chamber 58, as shown in FIG. 2. Therefore, at the time of being conveyed from the supply chamber 58 to the agitation chamber 59, the developer D mainly drops to the agitation chamber 59 via the third communication path 95 due to gravity. The remaining part of developer D that has not dropped via the third communication path 95 is conveyed to the front side of the copier 10 by the supply screw 52.

The part of the developer D conveyed to the front side of the copier 10 by the supply screw 52 passes over the outlet 99. Since the outlet 99 is closed, the developer D is not discharged outside the housing 50 and conveyed to the agitation chamber 59 via the first communication path 93. Unlike the trickle developing method, the developer D in the developing device 4Y is not discharged. This makes it possible to reduce the amount of developer required for developing, thus reducing cost.

In the non-trickle developing method, the first conveyance path 91, third communication path 95, the second conveyance path 92, and the second communication path 94 mainly constitute a circulation conveyance path 901 along which the developer D is circularly conveyed.

Figure 10A:
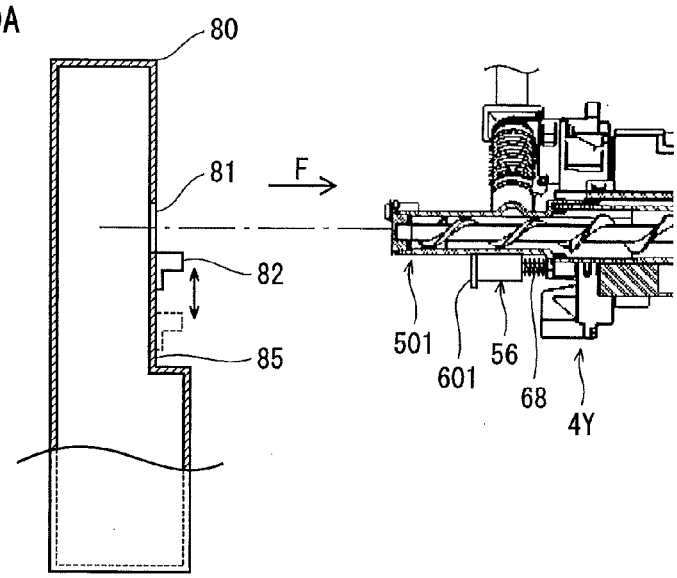
FIG. 10A shows a structure example of a collection tank mounted in the copier.
Figure 10B:
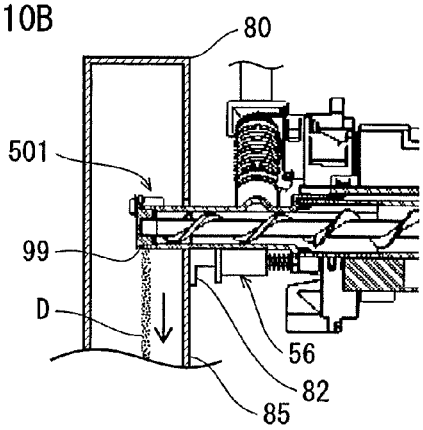
FIG. 10B shows a state where the shutter is switched to the first position by the collection tank.
Figure 10C:
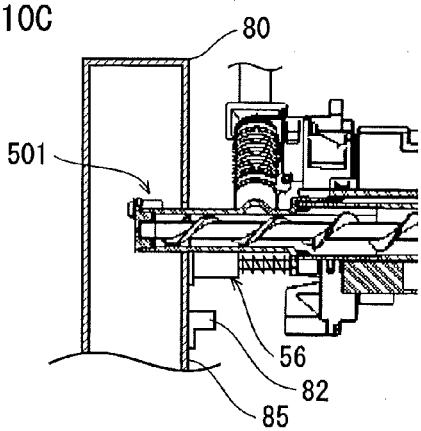
FIG. 10C shows a state where the shutter is switched to the second position by the collection tank.

FIG. 10A is a sectional view showing a state before the collection tank 80 is mounted in the copier 10, where a part of the collection tank 80 is shown by a side view. FIGS. 10B and 10C each show a state after the collection tank 80 is mounted in the copier 10. FIG. 10B shows an example of the case of the trickle developing method. FIG. 10C shows an example of the case of the non-trickle developing method.

As shown in FIG. 10A, a surface 85 of the collection tank 80 that faces the developing device 4Y is provided with an open hole 81. When being mounted in the copier 10, the collection tank 80 is fixedly held by the copier 10 in a state where an end portion 501 (a portion including the outlet 99) of the developing device 4Y at the front side of the copier 10 is inserted into the collection tank 80 via the open hole 81, as shown in FIGS. 10B and 10C.

The collection tank 80 has a projection 82, which is slidable up and down, at a position on the surface 85 thereof, in particular, at a position lower than the open hole 81. The projection 82 makes contact with the head portion 601 of the shutter 56 of the developing device 4Y, so as to switch the position of the shutter 56 between the trickle corresponding position and the non-trickle corresponding position. The position of the projection 82 is manually switchable by the user. When the user applies a certain degree of pressure to the projection 82, the projection 82 is switched between an uppermost position (shown by a solid line) and a lowermost position (shown by a dashed line) as shown in FIG. 10A. The position of the projection 82 is not switched by a pressure produced by, for example, vibrations of the copier 10 when images are formed.

In the case of switching to the trickle developing method, the user can mount the collection tank 80 to the copier 10 in the following manner. First, the user mounts the first cartridge 9Y to the hopper 7Y, and switches the position of the projection 82 to the uppermost position. Then, the user holds and inserts the collection tank 80 into the copier 10, from the front side of the copier 10 in a direction shown by the arrow F (i.e., direction toward the back side of the copier 10).

As shown in FIG. 10B, when the collection tank 80 is mounted in the copier 10 with the projection 82 being at the uppermost position, (i) the projection 82 makes contact with the head portion 601 of the shutter 56 of the developing device 4Y, and (ii) the head portion 601 is pressed toward the back side of the copier 10 (i.e., pressed against the biasing force of the compression coil spring 68), whereby the shutter 56 moves to the trickle corresponding position.

At the trickle corresponding position, the outlet 99 of the developing device 4Y is open. Therefore, while the developer D is circularly conveyed in the housing 50, a part of the developer D is discharged from the outlet 99 and collected into the collection tank 80.

In the case of switching to the non-trickle developing method, the user mounts the second cartridge 9Yb to the hopper 7Y instead of the first cartridge 9Y, and switches the position of the projection 82 from the uppermost position to the lowermost position, and thereafter mounts the collection tank 80 to the copier 10.

As shown in FIG. 10C, when the collection tank 80 is mounted in the copier 10 with the projection 82 being at the lowermost position, the projection 82 does not make contact with the head portion 601 of the shutter 56 of the developing device 4Y. As a result, the head portion 601 moves toward the front side of the copier 10 by the biasing force of the compression coil spring 68, whereby the shutter 56 moves to the non-trickle corresponding position.

At the non-trickle corresponding position, the outlet 99 of the developing device 4Y is closed. Therefore, although being circularly conveyed, the developer D is not discharged from the outlet 99.

Note that the collection tank 80 corresponds to (i.e., is commonly used by) each of the developing devices 4Y to 4K. Therefore, a pair of the open hole 81 and the projection 82 is provided for each of the developing devices 4Y to 4K, so that the position of the projection 82 is individually switchable for each developing device.

As described above, changing both the type of cartridge and the position of the shutter for each color enables the user to switch between the trickle developing method and the non-trickle developing method as desired at any time. Accordingly, it is not necessary to prepare both a developing device dedicated to the trickle developing method and a developing device dedicated to the non-trickle developing method, allowing the user to easily switch between the developing methods at low cost.

Figure 11:
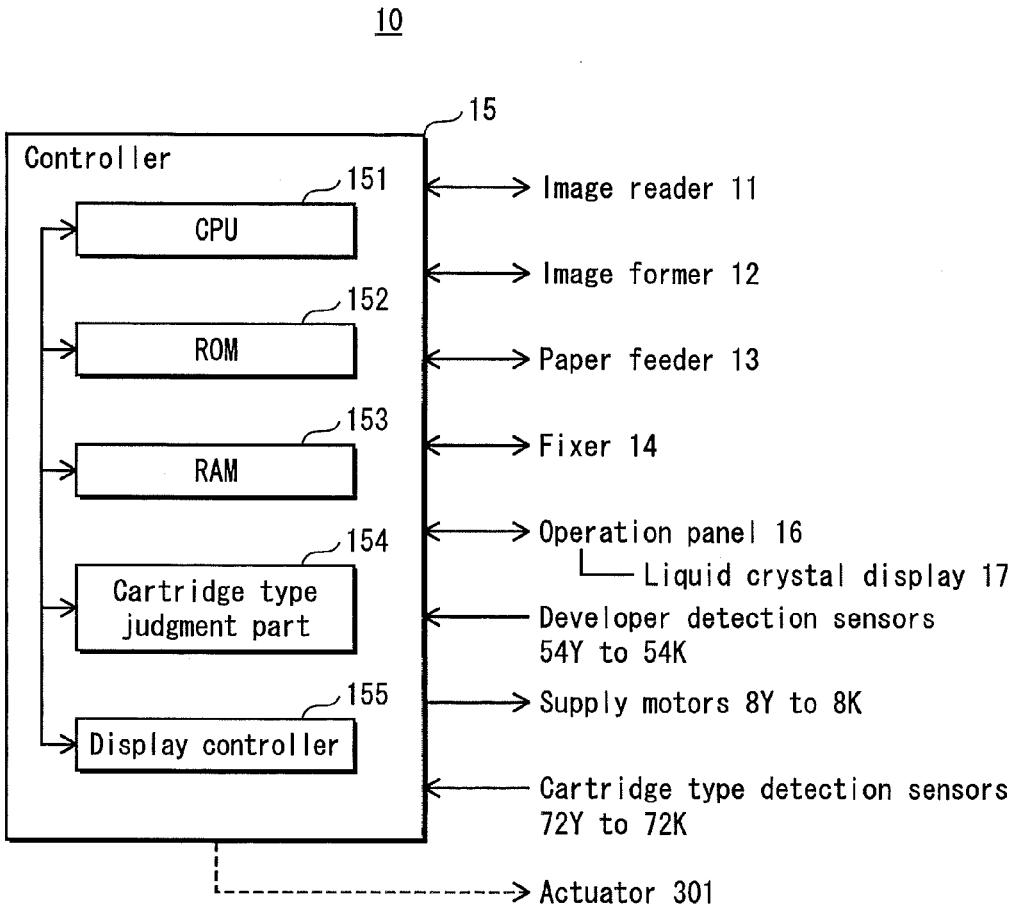
FIG. 11 is a block diagram showing a structure of a controller in the copier.

FIG. 11 is a block diagram showing a structure of the controller 15.

As shown in FIG. 11, the controller 15 includes a CPU 151, a ROM 152, a RAM 153, a cartridge type judgment part 154, and a display controller 155. These components 151 to 155 exchange data with each other.

The CPU 151 controls operations of components such as the image reader 11, the image former 12, and the paper feeder 13, based on a control program stored in the ROM 152, and thereby realizes smooth operations for forming color and monochrome images. Also, the CPU 151 receives information input by the user using the operation panel 16. Furthermore, based on the detection signals from the developer detection sensors 54Y to 54K, the CPU 151 judges whether the ratio of carriers to toner in the developer D currently contained in each of the developing devices 4Y to 4K falls within an appropriate range that is predetermined as a standard. When judging that the ratio of carriers and toner of any of the colors does not fall within the appropriate range, the CPU 151 performs control to cause one of the supply motors 8Y to 8K that corresponds to the color to be driven, so that the developer is supplied to the corresponding one of the developing devices 4Y to 4K and the ratio of carriers to toner of the color falls within the appropriate range.

This supply control is applied to both the trickle developing method and the non-trickle developing method. In this case, it is possible to employ a method in which the appropriate range is different for each color or each developing method. Alternatively, it is possible to employ a method of detecting the amount of developer contained in a developing device. Then, if the amount of developer in the developing device is detected to be smaller than an appropriate value that is a standard, an operation for supplying the corresponding developer may be performed until the amount of the developer reaches the appropriate value.

Also, the following method is possible. That is, the amount of toner consumed by developing is estimated based on the cumulative value of the number of pixels (i.e., dot count) when the laser beam emitted from an exposure part exposure-scans the corresponding photosensitive drum on a pixel-by-pixel basis. Then, the amount of developer corresponding to the estimated consumption amount is supplied to the corresponding developing device. By corresponding in advance one dot with the amount of toner supposedly consumed for forming a one-pixel image, the amount of consumed toner is estimated from the cumulative value of the dot count. Furthermore, it is possible to employ a method of detecting, with use of a reflective sensor or the like, the amount (i.e., density) of toner actually used to form a toner image on a photosensitive drum or on an intermediate transfer belt. According to this method, the detected amount of toner is considered as the amount of toner consumed for developing the toner image, and the amount of toner corresponding to the detected amount is supplied to the corresponding developing device. Also, it is possible to employ a supply method in which the aforementioned processes are combined. A supply method is selected based on the structure of a developing device, so that it is suitable for the developing device.

The RAM 153 is a work area for the CPU 151.

The cartridge type judgment part 154 receives detection signals (identification information pieces each indicating the type of cartridge) from the cartridge type detection sensors 72Y to 72K, judges whether the cartridges set in the respective hoppers 7Y to 7K are the first cartridge or the second cartridge (determines the type of cartridge), and transmits results of the judgment to the display controller 155.

The display controller 155 displays various pieces of information on the liquid crystal display 17 of the operation panel 16. Also, based on the results of the judgment from the cartridge type judgment part 154, the display controller 155 causes the liquid crystal display 17 to display a warning message which instructs the user to move the shutters 56 of the developing devices 4Y to 4K to the respective positions that correspond to the cartridges currently set to the developing devices 4Y to 4K.

Figure 12:
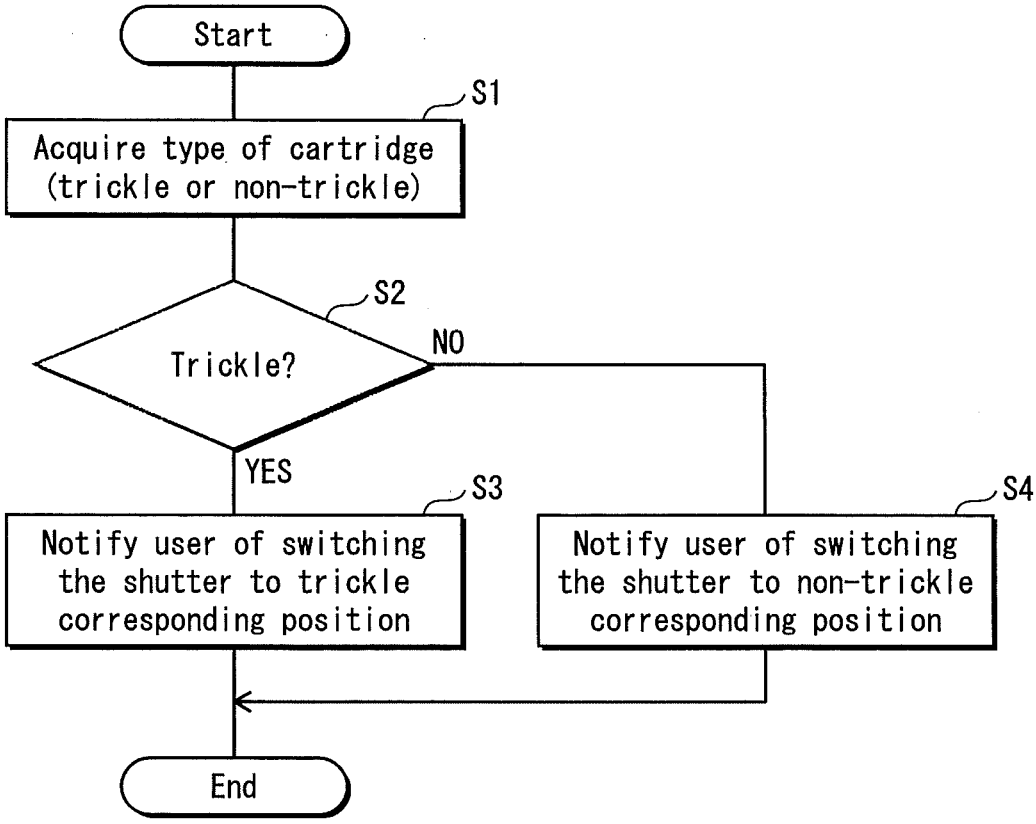
FIG. 12 is a flowchart showing the details of control for displaying a warning message, the control being performed by the controller.

FIG. 12 is a flowchart showing the details of control for displaying the warning message.

As shown in FIG. 12, the display controller 155 acquires the type of each of the cartridges set to the hoppers 7Y to 7K (step S1). The acquisition is performed by receiving results of judgment from the cartridge type judgment part 154.

When the type of cartridge is the first cartridge for the trickle developing method ("YES" in step S2), the display controller 155 causes the liquid crystal display 17 to display a warning message instructing the user to switch the position of the shutter 56 of the corresponding developing device to the trickle corresponding position (step S3), and ends the processing.

When the type of cartridge is the second cartridge for the non-trickle developing method ("NO" in step S2), the display controller 155 causes the liquid crystal display 17 to display a warning message instructing the user to switch the position of the shutter 56 of the corresponding developing device to the non-trickle corresponding position (step S4), and ends the processing.

The above processing is performed for each of the imaging parts 20Y to 20K.

Specifically, suppose that the first cartridges 9Y, 9M, and 9C for the trickle developing method are used for the colors Y, M, and C, and the second cartridge 9Kb for the non-trickle developing method is used for the color K. In this case, for example, the warning message indicates "Please set the projections 84 of the collection tank for the colors Y, M, and C to the uppermost positions, and set the projection 84 of the collection tank for the color K to the lowermost position".

The user can look at the warning message on the liquid crystal display 17, and switch, for each color, the position of the projection 84 on the collection tank 80 to either the trickle corresponding position (i.e., uppermost position) or the non-trickle corresponding position (i.e., lowermost position), or check whether the projections 84 are set to the respective positions indicated by the warning message. Note that the warning display described above is not limited to the message, and may be graphics showing the positions of the projections for the respective colors. Also, the warning described above does not always need to be displayed. For example, the warning may be provided by means of audio output or the like, as long as it can provide the user with a notification for indicating or warning about the positions of the shutters, in the same manner as the above warning message.

As for the timing for the warning, the user is preferably notified when the cartridge currently set is replaced with a new one. This is because of the following reason. If the new cartridge is of the same type as the previous one, the position of the shutter 56 does not need to be changed; however, if the new cartridge is of a different type from the previous one, the position of the shutter 56 needs to be changed to a position corresponding to the new cartridge. In the sense of encouraging the user to check the positions of the shutters 56, a notification such as a warning display may be provided for the user all the time.

With the stated structure, the following advantages are obtained. During a period in which the user often needs to print out images having high image quality (e.g., pictures), the user can set the first cartridges 9Y to 9K for the respective colors to the hoppers 7Y to 7K, and switch the position of each shutter 56 to the trickle corresponding position (i.e., switch each projection 84 to the uppermost position), so as to switch the developing method to the trickle developing method that gives priority to image quality. This makes it possible to form images having high image quality.

Subsequently, when the user needs to print out K-color images that do not require high image quality, such as images including only characters, the user can switch the developing method to the non-trickle developing method with respect to only the color K so as to give priority to cost-effectiveness. Specifically, the user can replace the first cartridge 9K with the second cartridge 9Kb, and switch only the position of the shutter 56 of the developing device 4K to the non-trickle corresponding position (i.e., switch the projection 84 to the lowermost position). This makes it possible to form character images of the color K at low cost. As described above, the developing method can be switched for each color between the trickle developing method and the non-trickle developing method.

Although it is described above that the shutter 56 is manually switched by the user as described above, the present invention is not limited to such. The present invention may take another structure as long as it enables switching between a first state and a second state, the first state being a state in which the two-component developer is discharged from the outlet 99 when the first developer Da is supplied, the second state being a state in which the two-component developer is not discharged from the outlet 99 when the second developer Db is supplied.

For example, it is possible, as described below, to dispose an actuator (e.g., solenoid) that has a function of switching the position of the shutter 56 between the trickle corresponding position and the non-trickle corresponding position by applying a pressure to the shutter 56 in the axis direction. Also, keys for receiving a user input specifying the position of the shutter 56 may be provided for the operation panel 16. Then, the actuator may be driven such that, when a key operation using the keys is performed by the user, the position of the shutter 56 is switched to the position specified by the key operation. This improves operability since the user does not need to directly hold the projection 84 and move the projection 84 up and down in order to switch the position of the shutter 56.

As described above, the shutter 56 is formed by integrating the first shutter part 61 for opening and closing the outlet 99 with the second shutter part 62 for opening and closing the third communication path 95, so that the outlet 99 and the third communication path 95 are opened and closed at the same time in conjunction with each other. However, the first shutter part 61 and the second shutter part 62 may be separately provided so that they can move separately from each other. In this way, the opening and closing of the outlet 99 may be performed separately from the opening and closing of the third communication path 95.

Embodiment 2

In Embodiment 1, the shutter 56 has a function of opening and closing both the outlet 99 and the third communication path 95. Embodiment 2 is different from Embodiment 1 in that the shutter opens and closes only the outlet 99 and an actuator opens and closes the third communication path 95. Hereinafter, descriptions that are the same as in Embodiment 1 are omitted to avoid repetition, and the same reference signs are given to components that are the same as in Embodiment 1.

Figure 13A:
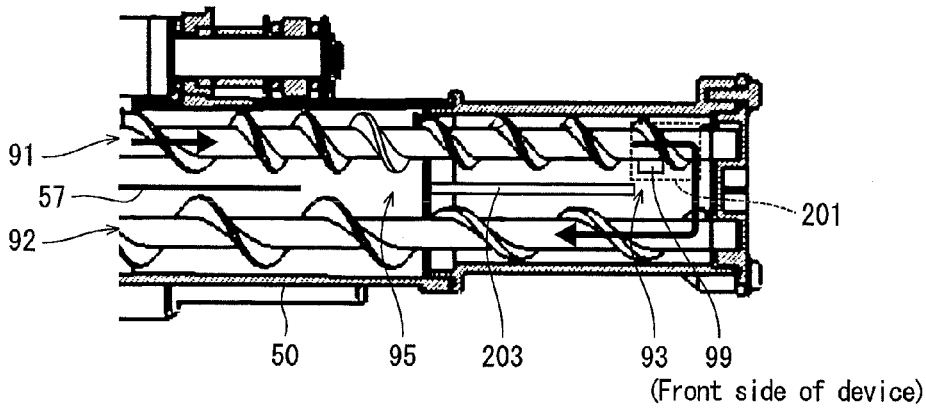
FIGS. 13A, 13B, and 13C show a structure of a shutter according to Embodiment 2.
Figure 13B:
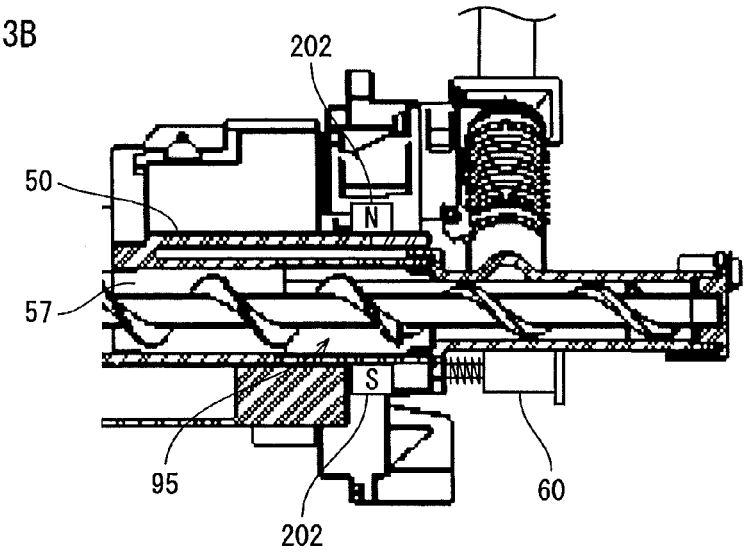

FIG. 13A shows a structure of a shutter 201 in the present embodiment, and FIG. 13B shows a structure of an actuator 202 (hereinafter also referred to as "magnetic field generators") for opening and closing the third communication path 95.

As shown in FIG. 13A, the shutter 201 corresponds to the first shutter part 61 in Embodiment 1, and does not include a part corresponding to the second shutter part 62 that serves as a part of the partition 57 between the supply chamber 58 and the agitation chamber 59. The part corresponding to the second shutter part 62 is provided for the housing 50 as a partition 203 that is stationary.

Accordingly, when the shutter 201 is slid in the axis direction, only the outlet 99 is opened and closed. In FIG. 13A, the shutter 201 is in a closed state which corresponds to the non-trickle developing method. Note that the shutter 201 includes the holder 60 in the same manner as the shutter 56 in Embodiment 1. Therefore, the outlet 99 is opened and closed by switching the position of the projection 84 of the collection tank 80 between the uppermost position and the lowermost position.

The third communication path 95 is not provided with a member that mechanically closes the third communication path 95. Instead, a pair of magnetic field generators 202 is provided outside the housing 50, as shown in FIG. 13B. Specifically, one of the magnetic field generators 202 is provided at a first position and the other of the magnetic field generators 201 is provided at a second position, the first and second positions sandwiching the third communication path 95 therebetween and being located along a direction perpendicular to the conveyance direction of the developer D. The magnetic field generators 202 generate a magnetic field, and thereby form a shield that is made of the developer D to close the third communication path 95.

Figure 13C:
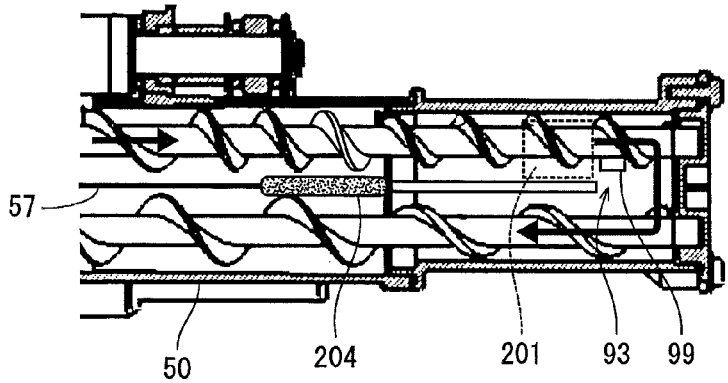

FIG. 13C schematically shows a state in which a shield 204 made of the developer D is formed in the third communication path 95.

Each of the magnetic field generators 202 is made of an electromagnet, and generates a magnetic field when an electric current is applied thereto. The carriers included in the developer D are magnetic. Therefore, when a magnetic field is generated by the magnetic field generators 202, the carriers in the developer D existing in the third communication path 95 and the toner attached to the carriers are attracted to the magnetic field generators 202 by a magnetic force, and stay in the third communication path 95.

The developer D staying in the third communication path 95 forms a shield 204 that separates the supply chamber 58 from the agitation chamber 59, and thereby blocks the third communication path 95 that is a path along which the developer D is conveyed. When the application of the electric current to the magnetic field generators 202 is stopped, the magnetic force that attracts the developer D to the magnetic field generators 202 disappears. As a result, the shield formed by the developer D is cleared, and the third communication path 95 in which the developer D is conveyed is opened.

Switching between the application and block of the electric current with respect to the magnetic field generators 202 is performed based on a result of judgment pertaining to the type of cartridge currently being set. That is, when the cartridge type judgment part 154 judges that the type of cartridge is the first cartridge for the trickle developing method, the controller 15 applies the electric current to the magnetic field generators 202 since the third communication path 95 needs to be closed. On the other hand, when the cartridge type judgment part 154 judges that the type of cartridge is the second cartridge for the non-trickle developing method, the controller 15 prohibits the application of the electric current to the magnetic field generators 202 since the third communication path 95 needs to be opened.

Note that the position of the shutter 201 is switched manually by the user in the same manner as in Embodiment 1. Therefore, a warning message is displayed that instructs the user which position the shutter 201 needs to be switched. The above structure is applied to each of the developing devices 4Y to 4K.

As described above, the third communication path 95 can be opened and closed by the magnetic field generated by the magnetic field generators 202, instead of the shutter. Note that the generation and suspension of the magnetic field, which are performed by the magnetic field generators 202, may be switched therebetween by the user using a switch or the like.

Embodiment 3

In the above embodiments, switching of the position of the shutter is manually performed by the user. Embodiment 3 is different from Embodiments 1 and 2 in that the user does not need to manually perform the switching operation.

Figure 14:
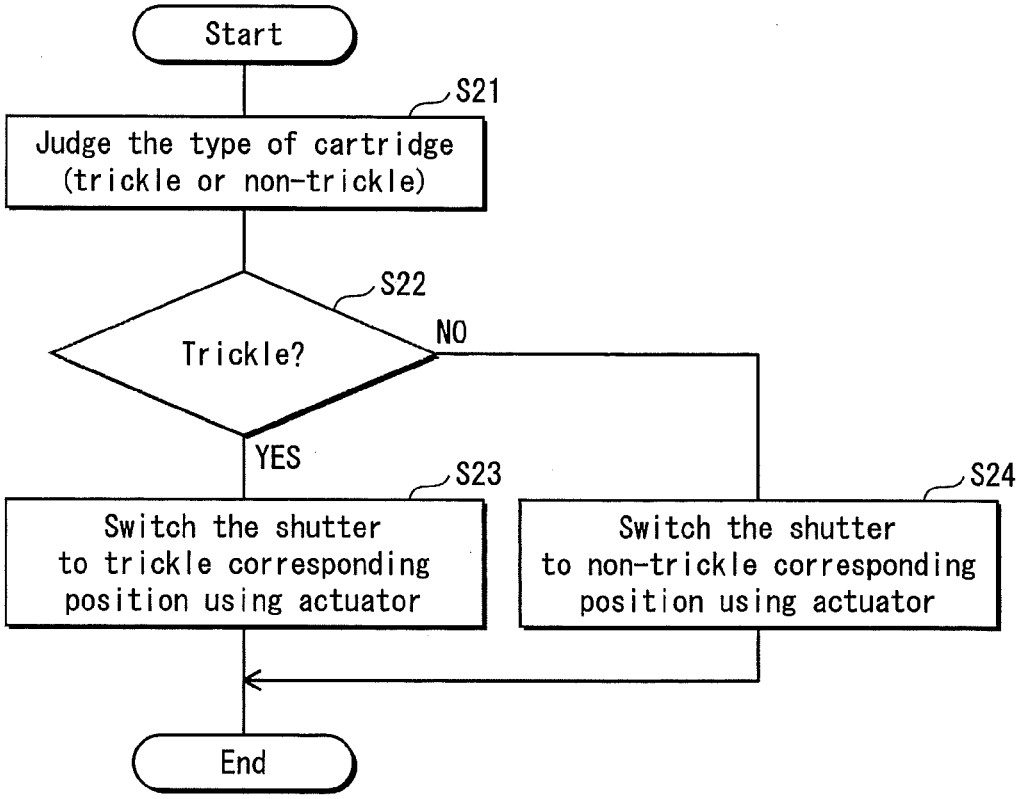
FIG. 14 is a flowchart showing the details of control for switching the position of the shutter according to Embodiment 3, the control being performed by the controller.

Specifically, the actuator 301 (see FIG. 11), such as a solenoid, is disposed on the developing device or the copier 10 itself. The actuator 301 can switch the position of the shutter 56 in Embodiment 1 between the trickle corresponding position and the non-trickle corresponding position by applying a pressure to the shutter 56 in the axis direction. As shown by the flowchart of FIG. 14 pertaining to control of the position of the shutter, the cartridge type judgment part 154 in the controller 15 judges the type of cartridge currently being set (step S21). When the cartridge type judgment part 154 judges that the type of cartridge is the first cartridge for the trickle developing method ("YES" in step S22), the controller 15 controls the drive of the actuator 301 so as to switch the shutter 56 to the trickle corresponding position (step S23), and ends the processing.

When the cartridge type judgment part 154 judges that the type of cartridge is the second cartridge for the non-trickle developing method ("NO" in step S22), the controller 15 controls the drive of the actuator 301 so as to switch the shutter 56 to the non-trickle corresponding position (step S24), and ends the processing. The above structure is applied to each of the developing devices 4Y to 4K.

With the stated structure, it is not necessary to display a warning for the user so as to encourage switching of the shutter position. Also, the user can switch between the developing methods by only setting a cartridge that corresponds to a desired developing method, to the corresponding hopper, thus improving convenience for the user.

The actuator 301 is not limited to a solenoid as long as it can move the shutter 56 by applying a pressure to the shutter 56 in the axis direction. For example, the actuator 301 may be a linear motor or a feed screw mechanism.

The present invention is not limited to an image forming apparatus and a developing device, and may be a method for switching between the aforementioned developing methods. Furthermore, the present invention may be a program that causes a computer to execute the method. Also, the program according to the present invention may be recorded on a computer-readable recording medium. Examples of such a computer-readable medium include (i) a magnetic disk such as a magnetic tape or a flexible disk, (ii) an optical recording medium such as a DVD, a CD-ROM, a CD-R, an MO, and a PD, and (iii) a flash memory-type recording medium including such as Smart Media™. The program may be manufactured and provided in the form of any of the aforementioned recording media. The program may also be transmitted and provided via a wired or wireless network including the Internet, broadcast, an electric communication line, satellite communication, etc.

<Modification>

Although the present invention has been described based on the embodiment, it is obvious that the present invention is not limited to the above-mentioned embodiment, and various modifications may be implemented.

(1) According to the above embodiments, one developing device is used for both the trickle developing method and the non-trickle developing method. In addition to this structure, it is possible to notify the user of the timing for switching between the developing methods.

For example, it is possible to cumulatively calculate, for each color, the operation time of the corresponding developing device in the non-trickle developing method. When the cumulative time exceeds a predetermined time length, the image forming apparatus may notify the user that the developing device needs to be switched to the trickle developing method, because the developer (especially carriers) in the developing device is deteriorated to a degree that lowers image quality by progression of abrasion of carrier particles by agitation or the like. Here, the notification may be provided for the user by, for example, display or audio as described above.

Suppose that the user is notified of switching from the non-trickle developing method to the trickle developing method, with respect to the developer device corresponding to the color Y. In this case, the user may perform the operations as described above. That is, the user may open the outer cover on the front side of the image forming apparatus, and set the first cartridge 9Y to the hopper 7Y, instead of the second cartridge 9Yb. After detaching the collection tank 80 and switching the position of the projection 84 for the color Y from the lowermost position to the uppermost position, the user may attach the collection tank 80 back to the image forming apparatus.

The above describes a structure example of notifying of switching from the non-trickle developing method to the trickle developing method. However, it is possible to employ a structure for notifying of switching from the trickle developing method to the non-trickle developing method instead. In other words, it is possible to cumulatively calculate, for each color, the operation time of the corresponding developing device in the trickle developing method. When the cumulative time exceeds a predetermined time length, the image forming apparatus may notify the user that the developing device is recommended to be switched to the non-trickle developing method, because the deterioration of the developer is resolved by the fresh developer replacing the deteriorated developer to a sufficient extent. In a case where the user switches to the non-trickle developing method according to the notification, the user may perform operations opposite from the aforementioned operations for replacing the cartridge and switching the position of the projection 84 of the collection tank 80.

The condition of notifying the user is not limited to the operation time, and may be information that indicates the degree of deterioration of the developer. For example, the condition may be the number of times images are formed (hereinafter "image formation count"), the remaining amount of the developer in the cartridge, the ratio of the number of times color images are formed (hereinafter "color image formation count") to the number of times monochrome images are formed (hereinafter "monochrome image formation count"), or the like.

The larger the image formation count, the longer the operation time. This means that deterioration in the developer has progressed. Therefore, when the image formation count exceeds a predetermined count, the image forming apparatus may notify the user that the non-trickle developing method needs to be switched to the trickle developing method.

Similarly, the smaller the remaining amount of the developer in the cartridge, the longer the operation time. Therefore, when the remaining amount is smaller than a predetermined amount, the image forming apparatus may notify the user that the non-trickle developing method can be switched to the trickle developing method.

Also, the larger the ratio of the color image formation count to the monochrome image formation count, the greater the frequency of use of the developing devices 4Y, 4M, and 4C for forming color images. This means that the deterioration of developers contained in the developing devices 4Y, 4M, and 4C has progressed. Therefore, when the ratio exceeds a predetermined value, the image forming apparatus may notify the user that the developing methods of only the developing devices for forming color images need to be switched from the non-trickle developing method to the trickle developing method. Note that the developing method of the developing device 4K may also be switched to the trickle developing method, together with the developing devices 4Y, 4M, and 4C. The user can arbitrarily switch between the developing methods as desired.

In the case where the position of the shutter 56 is automatically switched as described in Embodiment 3, the following structure is possible. That is, after the user switches a cartridge according to the aforementioned notification, the position of the shutter 56 may be automatically switched to the position corresponding to the type of the cartridge set after the switching. Regarding the notification of switching between the developing methods as described above, it is possible to notify either one or both of (i) the switching from the non-trickle developing method to the trickle developing method and (ii) the switching from the trickle developing method to the non-trickle developing method.

(2) In Embodiment 1, the projection 84 is provided for the collection tank 80 which is a different member from the shutter 56. The projection 84 is capable to be switched between a state of being engaged with the shutter 56 and a state of being disengaged with the shutter 56, so as to switch the position of the shutter 56 between the trickle corresponding position and the non-trickle corresponding position. However, the present invention is not limited to such. The present invention may employ a different member as long as the member can switch the position of the shutter 56. For example, the shutter 56 may be fixed to the housing 50 by a fixing screw at either the trickle corresponding position or the non-trickle corresponding position. When switching the position of the shutter 56, the user may remove the fixing screw and, after switching the position, tighten the fixing screw again. The present invention may employ another structure or method different from those described above.

(3) In the above embodiments, the first communication path 93 and the third communication path 95 are provided as parts of the circulation conveyance path of the developer D. Also, the outlet 99 is arranged in the first conveyance path 91, at a portion from (i) a connected portion in which the first conveyance path 91 is connected to the third communication path 95 to (ii) a connected portion in which the first conveyance path 91 is connected to the first communication path 93 located in the downstream side in the developer conveyance direction (i.e., X direction), inclusive of the connected portions. However, the position of the outlet 99 is not limited to such.

For example, the outlet 99 may be arranged in the first communication path 93. Alternatively, the outlet 99 may be arranged in the second conveyance path 92, at a portion from (i) a connected portion in which the second conveyance path 92 is connected to the first communication path 93 to (ii) the inlet 98 (i.e., supply position) for receiving the developer located in the downstream side in the developer conveyance direction (i.e., X' direction), inclusive of the connected portion and exclusive of the inlet 98.

Also, depending on the positional relationship with the inlet 98, the outlet 99 may be arranged in a portion different from the aforementioned portions. For example, suppose that the inlet 98 is arranged in a portion of the second conveyance path 92, at either the connected portion in which the second conveyance path 92 is connected to the third communication path 95 or a portion of the second conveyance path 92 that is located more downstream than the connected portion in the developer conveyance direction. In this case, the outlet 99 may be arranged in any of the following portions: (i) a portion of the first conveyance path 91 that is located more downstream in the developer conveyance direction than the connected portion in which the first conveyance path 91 is connected to the third communication path 95; (ii) the first communication path 93; and (iii) a portion of the second conveyance path 92 that is located more upstream in the developer conveyance direction than the connected portion in which the second conveyance path 92 is connected to the third communication path 95. Note that the outlet 99 does not always need to be arranged at the bottom of a chamber of the housing 50, such as the supply chamber 58. The outlet 99 may be arranged at a side of a chamber of the housing 50 as long as the developer D currently being conveyed can be discharged outside the housing 50.

Furthermore, according to the above embodiment, the shutter 56 opens the outlet 99 and closes the third communication path 95 in the trickle developing method. Also, the shutter 56 closes the outlet 99 and opens the third communication path 95 in the non-trickle developing method. However, it is not limited to such. The present invention may employ a different structure as long as the structure enables switching between a state in which the developer is discharged from the outlet and a state in which the developer is not discharged from the outlet.

For example, the following structure is possible. That is, the first conveyance path 91 may be split into two conveyance paths, i.e., a conveyance path A and a conveyance path B (each corresponding to a communication path), at the end of the first conveyance path 91 on the downstream side in the developer conveyance direction. Also, the conveyance paths A and B may be joined together at the end portion of the second conveyance path 92 in the upstream side in the developer conveyance direction. Further, the conveyance path A may be provided with an inlet whereas the conveyance path B may not be provided with an inlet. In this state, the image forming apparatus may be capable of switching the conveyance path of the developer D from the conveyance path A to the conveyance path B or from the conveyance path B to the conveyance path A.

In this case, the conveyance path is switched to the conveyance path A in the trickle developing method, and to the conveyance path B in the non-trickle developing method. According to the stated structure, the outlet is not opened or closed. Instead, the conveyance path for the developer D is switched between the conveyance path A having the outlet and the conveyance path B having no outlet, whereby the state of the image forming apparatus is switched between the state in which the developer is discharged from the outlet and the state in which the developer is not discharged from the outlet.

Also, the circulation conveyance path is not limited to the above embodiments. For example, the circulation conveyance path of the housing 50 may not include the third communication path 95, and may only include the first conveyance path, the first communication path, the second conveyance path, and the second communication path. Then, the outlet may be arranged in any of the following portions: a portion of the first conveyance path that is more downstream than a portion of the first conveyance path facing the developing roller 51 in the developer conveyance direction; the first communication path; and a portion of the second conveyance path that is more upstream than the inlet 98 in the developer conveyance direction. The outlet may be opened or closed depending on whether the developing method is the trickle developing method or the non-trickle developing method. Regarding the opening and closing of the outlet, it is not limited to the structure for switching the shutter between the position for closing the outlet and the position away from the outlet to open the outlet. For example, it is possible to employ a structure where the outlet is provided with a diaphragm mechanism including a plurality of overlapping plates. In this case, the outlet is opened and closed by moving the overlapping plates.

(4) The above embodiments are described with an example of the tandem-type color digital copier. However, the present invention is not limited to such, and is applicable to a color or monochrome image forming apparatus in general, such as a printer, a FAX (facsimile), or an MFP (Multiple Function Peripheral) as long as the image forming apparatus includes at least one developing device and a hopper for supplying developer to the developing device.

Also, according to the above embodiments, the first developer Da includes carriers and toner. However, the first developer Da may include carriers and not toner. In this case, the image forming apparatus further includes another hopper for supplying toner, and performs supply control separately on each of the hoppers, i.e., (i) the hopper for supplying toner and (ii) the hopper for supplying the first developer Da including carriers and not toner. Details of a structure for supplying carriers and toner separately are disclosed in the aforementioned Japanese examined patent application publication, for example.

Furthermore, the present invention may include a structure where the developing device in the image forming apparatus is detachable by the user or the like.

Also, according to the above embodiments, the photosensitive drums are used as image carriers for forming an electrostatic latent image. However, it is not limited to such. For example, it is possible to employ belt-like image carriers. Furthermore, it is described above that the developing roller having the sleeve is used as a developer carrier for carrying the developer D. However, it is not limited to such. It is possible to employ a different member as a developer carrier, as long as it carries the developer D.

Also, the present invention may be any combination of the embodiments and the modifications described above.

CONCLUSION

Each of the embodiment and modifications shown above is an aspect of the present invention to solve the problems discussed in the section of "BACKGROUND OF THE INVENTION". The embodiment and modifications shown above are summarized as follows.

(1) A first aspect of the present invention is an image forming apparatus for developing an electrostatic latent image on an image carrier with use of a two-component developer including carriers and toner, the image forming apparatus comprising: a developing device having (i) a conveyance path in which the two-component developer is conveyed and (ii) an outlet from which the two-component developer is partially discharged while the two-component developer is conveyed; a hopper to which (i) a first cartridge containing a first developer including carriers and (ii) a second cartridge containing a second developer including toner and not carriers are attachable, and operable, when the first cartridge is attached thereto, to supply the first developer to the developing device, and when the second cartridge is attached thereto, to supply the second developer to the developing device; and a switching part operable, when the first developer is supplied, to switch the developing device to a first state in which the two-component developer is partially discharged from the outlet, and when the second developer is supplied, to switch the developing device to a second state in which the two-component developer is not discharged from the outlet.

(2) A second aspect of the present invention is the image forming apparatus of (1), wherein the switching part switches the developing device to the first state by opening the outlet, and switches the developing device to the second state by closing the outlet.

(3) A third aspect of the present invention is the image forming apparatus of (2), wherein the conveyance path is a circulation conveyance path in which the two-component developer is circularly conveyed, and includes: a first conveyance path that is linear and in which the two-component developer is conveyed in a first conveyance direction; a second conveyance path that is arranged parallel to the first conveyance path, and in which the two-component developer is conveyed in a second conveyance direction opposite the first conveyance direction; a first communication path for communicating a first portion of the first conveyance path located downstream in the first conveyance direction, with a first portion of the second conveyance path located upstream in the second conveyance direction; a second communication path for communicating a second portion of the second conveyance path located downstream in the second conveyance direction, with a second portion of the first conveyance path located upstream in the first developer conveyance path; and a third communication path for communicating a third portion of the first conveyance path with a third portion of the second conveyance path, the third portion of the first conveyance path located more upstream in the first conveyance direction than the first portion thereof, the third portion of the second conveyance path located more downstream in the second conveyance direction than the first portion thereof, the outlet is arranged in any of the following portions: (i) a portion of the first conveyance path located more downstream in the first conveyance direction than the third portion of the first conveyance path; (ii) the first communication path; and (iii) a portion of the second conveyance path located more upstream in the second conveyance direction than the third portion of the second conveyance path, and the switching part closes the third communication path when opening the outlet, and opens the third communication path when closing the outlet.

(4) A fourth aspect of the present invention is the image forming apparatus of (3), wherein the switching part includes:

a first shutter operable to move between a first opening position and a first closing position, the first opening position being for opening the outlet by the first shutter separating from the outlet, the first closing position being for closing the outlet by the first shutter covering the outlet; and a second shutter operable to move between a second opening position and a second closing position, the second opening position being for opening the third communication path by the second shutter separating from the third communication path, the second closing position being for closing the third communication path by the second shutter cutting across the third communication path.

(5) A fifth aspect of the present invention is the image forming apparatus of (4), wherein the first shutter is integrated with the second shutter to constitute an integrated shutter, and the integrated shutter is operable to move between a first position and a second position, the first position being a position at which the first shutter is located at the first opening position for opening the outlet and the second shutter is located at the second closing position for closing the third communication path, the second position being a position at which the first shutter is located at the first closing position for closing the outlet and the second shutter is located at the second opening position for opening the third communication path.

(6) A sixth aspect of the present invention is the image forming apparatus of (5), wherein the integrated shutter is manually movable by a user.

(7) A seventh aspect of the present invention is the image forming apparatus of (6) further comprising: a detector operable to detect a type of cartridge mounted in the hopper; and a notifier operable to notify the user that the integrated shutter needs to be located at the first position when the type of cartridge is detected to be the first cartridge, and that the integrated shutter needs to be located at the second position when the type of cartridge is detected to be the second cartridge.

(8) An eighth aspect of the present invention is the image forming apparatus of (5) further comprising: a detector operable to detect a type of cartridge mounted in the hopper; an actuator operable to move the integrated shutter between the first position and the second position; and a controller operable to control the actuator, wherein the controller operable to drive the actuator to cause the integrated shutter to move to the first position when the type of cartridge is detected to be the first cartridge, and to cause the integrated shutter to move to the second position when the type of cartridge is detected to be the second cartridge.

(9) A ninth aspect of the present invention is the image forming apparatus of (3), wherein the switching part includes: a shutter operable to open and close the outlet; and a magnetic field generator operable to switch between generation and suspension of a magnetic field, the magnetic field being for forming a developer shield by causing the two-component developer existing in the third communication path to stay therein.

(10) A tenth aspect of the present invention is the image forming apparatus of (9), wherein the shutter is manually movable by a user between (i) an opening position for opening the outlet by the shutter separating from the outlet and (ii) a closing position for closing the outlet by the shutter covering the outlet.

(11) An eleventh aspect of the present invention is the image forming apparatus of (10) further comprising: a detector operable to detect a type of cartridge mounted in the hopper; a notifier operable to notify the user that the shutter needs to be located at the opening position when the type of cartridge is detected to be the first cartridge, and that the shutter needs to be located at the closing position when the type of cartridge is detected to be the second cartridge; and a controller operable to control the magnetic field generator to generate the magnetic field when the type of cartridge is detected to be the first cartridge, and to suspend the generation of the magnetic field when the type of cartridge is detected to be the second cartridge.

(12) A twelfth aspect of the present invention is the image forming apparatus of (1) further comprising: an acquisition part operable to acquire information indicating a degree of deterioration of the two-component developer contained in the developing device; and a switching notifier operable to notify a user of a timing of switching between a first developing method and a second developing method based on the information acquired by the acquisition part, the first developing method being a method for developing the electrostatic latent image with a supply of the first developer, the second developing method being a method for developing the electrostatic latent image with a supply of the second developer.

(13) A thirteenth aspect of the present invention is a developing device mounted in an image forming apparatus, and for developing an electrostatic latent image on an image carrier with use of a two-component developer including carriers and toner, the developing device comprising: a conveyance path in which the two-component developer is conveyed, an outlet that is provided in the conveyance path and from which the two-component developer is partially discharged while the two-component developer is conveyed; an inlet that is provided in the conveyance path and from which (i) a first developer including carriers is supplied when a cartridge containing the first developer is attached to the image forming apparatus and (ii) a second developer including toner and not carrier is supplied when a cartridge containing the second developer is attached to the image forming apparatus; and a switching part operable, when the first developer is supplied, to switch the developing device to a first state in which the two-component developer is discharged from the outlet, and when the second developer is supplied, to switch the developing device to a second state in which the two-component developer is not discharged from the outlet.

According to the stated structure, the user can switch between the first developing method and the second developing method as desired. Specifically, when the user desires high image quality, images are developed by means of the first developing method in which, while the first developer is supplied from the cartridge containing the first developer, the two-component developer in the developing device is discharged from the outlet. Also, when the user desires low cost, images are developed by means of the second developing method in which, although the second developer is supplied from the cartridge containing the second developer, the two-component developer in the developing device is not discharged from the outlet. As a result, the user does not need to prepare two types of developing devices, i.e., one for the first developing method and the other for the second developing method. This eliminates the need for the user to manage two types of developing devices, and thus improves convenience for the user.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus for developing an electrostatic latent image on an image carrier with use of a two-component developer including carriers and toner, the image forming apparatus comprising:

a developing device having (i) a conveyance path in which the two-component developer is conveyed and (ii) an outlet from which the two-component developer is partially discharged while the two-component developer is conveyed;

a hopper to which (i) a first cartridge containing a first developer including carriers and (ii) a second cartridge containing a second developer including toner and not carriers are attachable, and operable, when the first cartridge is attached thereto, to supply the first developer to the developing device, and when the second cartridge is attached thereto, to supply the second developer to the developing device; and a switching part operable, when the first developer is supplied, to switch the developing device to a first state by opening the outlet, the first state being a state in which the two-component developer is partially discharged from the outlet, and when the second developer is supplied, to switch the developing device to a second state by closing the outlet, the second state being a state in which the two-component developer is not discharged from the outlet, wherein the conveyance path is a circulation conveyance path in which the two-component developer is circularly conveyed, and includes:

a first conveyance path that is linear and in which the two-component developer is conveyed in a first conveyance direction;

a second conveyance path that is arranged parallel to the first conveyance path, and in which the two-component developer is conveyed in a second conveyance direction opposite the first conveyance direction;

a first communication path for communicating a first portion of the first conveyance path located downstream in the first conveyance direction, with a first portion of the second conveyance path located upstream in the second conveyance direction;

a second communication path for communicating a second portion of the second conveyance path located downstream in the second conveyance direction, with a second portion of the first conveyance path located upstream in the first developer conveyance path; and a third communication path for communicating a third portion of the first conveyance path with a third portion of the second conveyance path, the third portion of the first conveyance path located more upstream in the first conveyance direction than the first portion thereof, the third portion of the second conveyance path located more downstream in the second conveyance direction than the first portion thereof, the outlet is arranged in any of the following portions: (i) a portion of the first conveyance path located more downstream in the first conveyance direction than the third portion of the first conveyance path; (ii) the first communication path; and (iii) a portion of the second conveyance path located more upstream in the second conveyance direction than the third portion of the second conveyance path, and the switching part closes the third communication path when opening the outlet, and opens the third communication path when closing the outlet.

2. The image forming apparatus of claim 1, wherein the switching part includes:

a first shutter operable to move between a first opening position and a first closing position, the first opening position being for opening the outlet by the first shutter separating from the outlet, the first closing position being for closing the outlet by the first shutter covering the outlet; and a second shutter operable to move between a second opening position and a second closing position, the second opening position being for opening the third communication path by the second shutter separating from the third communication path, the second closing position being for closing the third communication path by the second shutter cutting across the third communication path.

3. The image forming apparatus of claim 2, wherein the first shutter is integrated with the second shutter to constitute an integrated shutter; and the integrated shutter is operable to move between a first position and a second position, the first position being a position at which the first shutter is located at the first opening position for opening the outlet and the second shutter is located at the second closing position for closing the third communication path, the second position being a position at which the first shutter is located at the first closing position for closing the outlet and the second shutter is located at the second opening position for opening the third communication path.

4. The image forming apparatus of claim 3, wherein the integrated shutter is manually movable by a user.

5. The image forming apparatus of claim 4 further comprising:

a detector operable to detect a type of cartridge mounted in the hopper; and a notifier operable to notify the user that the integrated shutter needs to be located at the first position when the type of cartridge is detected to be the first cartridge, and that the integrated shutter needs to be located at the second position when the type of cartridge is detected to be the second cartridge.

6. The image forming apparatus of claim 3 further comprising:

a detector operable to detect a type of cartridge mounted in the hopper;

an actuator operable to move the integrated shutter between the first position and the second position; and a controller operable to control the actuator, wherein the controller operable to drive the actuator to cause the integrated shutter to move to the first position when the type of cartridge is detected to be the first cartridge, and to cause the integrated shutter to move to the second position when the type of cartridge is detected to be the second cartridge.

7. The image forming apparatus of claim 1, wherein the switching part includes:

a shutter operable to open and close the outlet; and a magnetic field generator operable to switch between generation and suspension of a magnetic field, the magnetic field being for forming a developer shield by causing the two-component developer existing in the third communication path to stay therein.

8. The image forming apparatus of claim 7, wherein the shutter is manually movable by a user between (i) an opening position for opening the outlet by the shutter separating from the outlet and (ii) a closing position for closing the outlet by the shutter covering the outlet.

9. The image forming apparatus of claim 8 further comprising:

a detector operable to detect a type of cartridge mounted in the hopper;

a notifier operable to notify the user that the shutter needs to be located at the opening position when the type of cartridge is detected to be the first cartridge, and that the shutter needs to be located at the closing position when the type of cartridge is detected to be the second cartridge; and a controller operable to control the magnetic field generator to generate the magnetic field when the type of cartridge is detected to be the first cartridge, and to suspend the generation of the magnetic field when the type of cartridge is detected to be the second cartridge.

10. The image forming apparatus of claims 1 further comprising:

an acquisition part operable to acquire information indicating a degree of deterioration of the two-component developer contained in the developing device; and a switching notifier operable to notify a user of a timing of switching between a first developing method and a second developing method based on the information acquired by the acquisition part, the first developing method being a method for developing the electrostatic latent image with a supply of the first developer, the second developing method being a method for developing the electrostatic latent image with a supply of the second developer.

11. A developing device mounted in an image forming apparatus, and for developing an electrostatic latent image on an image carrier with use of a two-component developer including carriers and toner, the developing device comprising:

a conveyance path in which the two-component developer is conveyed, an outlet that is provided in the conveyance path and from which the two-component developer is partially discharged while the two-component developer is conveyed;

an inlet that is provided in the conveyance path and from which (i) a first developer including carriers is supplied when a cartridge containing the first developer is attached to the image forming apparatus and (ii) a second developer including toner and not carrier is supplied when a cartridge containing the second developer is attached to the image forming apparatus; and a switching part operable, when the first developer is supplied, to switch the developing device to a first state by opening the outlet, the first state being a state in which the two-component developer is partially discharged from the outlet, and when the second developer is supplied, to switch the developing device to a second state by closing the outlet, the second state being a state in which the two-component developer is not discharged from the outlet, wherein the conveyance path is a circulation conveyance path in which the two-component developer is circularly conveyed, and includes:

a first conveyance path that is linear and in which the two-component developer is conveyed in a first conveyance direction;

a second conveyance path that is arranged parallel to the first conveyance path, and in which the two-component developer is conveyed in a second conveyance direction opposite the first conveyance direction;

a first communication path for communicating a first portion of the first conveyance path located downstream in the first conveyance direction, with a first portion of the second conveyance path located upstream in the second conveyance direction;

a second communication path for communicating a second portion of the second conveyance path located downstream in the second conveyance direction, with a second portion of the first conveyance path located upstream in the first developer conveyance path; and a third communication path for communicating a third portion of the first conveyance path with a third portion of the second conveyance path, the third portion of the first conveyance path located more upstream in the first conveyance direction than the first portion thereof, the third portion of the second conveyance path located more downstream in the second conveyance direction than the first portion thereof, the outlet is arranged in any of the following portions: (i) a portion of the first conveyance path located more downstream in the first conveyance direction than the third portion of the first conveyance path; (ii) the first communication path; and (iii) a portion of the second conveyance path located more upstream in the second conveyance direction than the third portion of the second conveyance path; and the switching part closes the third communication path when opening the outlet, and opens the third communication path when closing the outlet.

* * * * *